US005752486A

United States Patent [19]

Nakashima et al.

[11] Patent Number: 5,752,486

[45] Date of Patent: May 19, 1998

[54] ACCUMULATOR FUEL INJECTION DEVICE

[75] Inventors: Tatsushi Nakashima; Atsuya Okamoto; Niro Takaki, all of Nishio, Japan

[73] Assignee: Nippon Soken Inc., Nishio, Japan

[21] Appl. No.: 768,925

[22] Filed: Dec. 18, 1996

[30] Foreign Application Priority Data

Dec. 19, 1995 [JP] Japan ..... 7-330628
Oct. 14, 1996 [JP] Japan ..... 8-270930

[51] Int. Cl.[6] ..... F02M 37/04

[52] U.S. Cl. ..... 123/467; 123/456; 123/447

[58] Field of Search ..... 123/456, 467, 123/447, 510, 497

[56] References Cited

U.S. PATENT DOCUMENTS 4,526,151 7/1985 Tateishi ..... 123/468
5,297,523 3/1994 Hafner ..... 123/456
5,373,824 12/1994 Peters ..... 123/456
5,390,692 2/1995 Jones ..... 123/467
5,467,754 11/1995 Beck ..... 123/467

FOREIGN PATENT DOCUMENTS 0 088 9/1983 European Pat. Off. .
0 385 399 9/1990 European Pat. Off. .
0 531 533 A1 3/1993 European Pat. Off. .
4-330373 11/1992 Japan .
6-147050 5/1994 Japan .

*Primary Examiner*—Carl S. Miller
*Attorney, Agent, or Firm*—Cushman Darby & Cushman IP Group of Pillsbury Madison & Sutro LLP

[57] ABSTRACT

In an accumulator fuel injection device pulsating of pressure is suppressed and fluctuation of fuel injection is prevented by providing flow rate control means such as an orifice generating a flow rate regulated at a fuel passage of a diesel engine. The device supplies fuel to injectors of cylinders from a pump pressurizing the fuel to a high pressure through a common rail which can stock high pressure fuel or through a corresponding fuel passage having a large volume.

20 Claims, 20 Drawing Sheets

ACCUMULATOR FUEL INJECTION DEVICE

BACKGROUND OF THE INVENTION

1. Field of the Invention

The present invention relates to an accumulator fuel injection device used for a diesel engine.

2. Description of the Related Art

In an accumulator fuel injection device for a diesel engine, a pressure pulsation occurs in the injection pipes, that is, the fuel passages extending from a common rail for accumulating high pressure fuel to the fuel injectors. This pressure pulsation is due to the propagation of a discharged water hammer when a high pressure feed pump which pressurizes the fuel to a high pressure and feeds this to the common rail discharges fuel of high pressure and is also due to the propagation of an injected water hammer when the fuel of the high pressure is injected from the fuel injectors. For this reason, there is a problem in that the fuel pressure in the nozzles of the fuel injectors fluctuates immediately before the injection and a variation of the fuel injection amount occurs among the cylinders of the engine.

To deal with this problem, in the related art disclosed in Japanese Unexamined Patent Publication (Kokai) No. 4-330373, the countermeasure has been devised of providing a partition wall having an orifice at a center portion of the common rail to divide the internal space of the common rail into two. In order for this method to achieve a sufficient effect, however, the plurality of pumps and fuel injectors connected to the two chambers in the common rail must be distributed, thereby taking into consideration the fuel injection timing etc. of the cylinders so that discharges and injection of fuel do not occur overlappingly among the pumps and injectors connected to the same chamber in the common rail. Further, when a pressure difference is produced between two chambers in the common rail by the orifice, there is a time delay until the pressures of the two chambers become uniform, so there also exists a problem when the pressure of the fuel supplied to the fuel injector becomes slightly different according to the cylinders.

Further, in a conventional three-way valve type or two-way valve type injector, where a so-called "pilot injection" is performed to open an injection port for just a relatively short time to inject a small amount of fuel before the main injection at which the injection port is opened by a relatively large amount by the movement of the needle, a pressure pulsation is generated in a control chamber and an oil accumulation chamber upon which the fuel pressure for driving the needle acts due to the water hammer (discharged water hammer) at the time of the pilot injection. Therefore, there is a problem in that the pattern of the injection amount and injection rate at the main injection for injecting a large amount of fuel becomes unstable.

In order to solve this problem, in the related art disclosed in Japanese Unexamined Patent Publication (Kokai) No. 6-147050, a plurality of fuel passages are provided on the control chamber side for connecting the fuel passages that communicate with the common rail and the feed port to the control chamber, whereby attenuation of the pressure pulsation in the control chamber is promoted. In this method as well, however, when the interval of the pilot injection and main injection is relatively short, the attenuation of the pressure pulsation is not sufficient, so the above problem cannot be completely solved. Further, no countermeasure is taken for the fuel passages on the oil accumulation chamber side, so the pulsation of the fuel pressure acting upon the oil accumulation chamber cannot be reduced as in the related art developed previously.

SUMMARY OF THE INVENTION

An object of the present invention is to provide an improved accumulator fuel injection device whereby the pressure pulsation in the fuel passages due to the propagation of the discharged water hammer by the high pressure feed pump and the injected water hammer by the fuel injectors can be effectively suppressed so as to deal with the problems in the related art as mentioned above.

Another object of the present invention is to provide an improved accumulator fuel injection device whereby pressure pulsation in the fuel passages on the supply side with respect to the injectors can be effectively suppressed at not only the time of main injection but also at the time of pilot injection in a case where a pilot injection is carried out before the main injection in the accumulator fuel injection device.

The objects of the present invention are solved by the accumulator fuel injection device disclosed in the claims. The present invention comprises an accumulator fuel injection device provided with a plurality of fuel injectors receiving the supply of high pressure fuel from a common rail or something corresponding to this. At least one of a fuel supply passage, the common rail, fuel distribution passages, and passages inside the fuel injectors is provided with flow rate control means so that, for the flow rate of the fuel generated in the at least one passage when a fuel injector injects the fuel, fuel has a flow rate characterized by the ratio obtained by taking the difference between, first, the sum of the volume of the common rail and the volume of all of the distribution passages and the supply passage, that is, the total pipe volume, and, secondly, the volume of the distribution passages and dividing by the total pipe volume.

By providing in this way flow rate control means for generating a flow rate of a magnitude specified by the present invention in accordance with the volume of the fuel passages somewhere in the fuel passages through which the fuel of a high pressure pressurized by the high pressure feed pump is guided to the internal portion of the fuel injectors after passing through the common rail, the propagation of the pressure pulsation due to the discharged water hammer of the high pressure feed pump and the injected water hammer of the fuel injectors is suppressed. More concretely, in one aspect of the accumulator fuel injection device of the present invention, the flow rate control means is provided at a connecting point of the common rail and the fuel distribution passages branched from this. Further, as the flow rate control means, an orifice having a constant opening diameter for throttling the flow of the fuel is used. Further, in another aspect of the present invention, as the flow rate control means includes a variable orifice comprising a differential pressure valve with an opening which is changed in size according to the difference between pressures before and after the variable orifice, and the pressure pulsation in the fuel passage is effectively suppressed corresponding to the pressure pulsation due to the injected water hammer with an intensity which changes in accordance with the change of the operating conditions.

The objects of the present invention are also solved by another aspect, that is, by providing flow rate control means for generating a flow rate of a magnitude specified according to the present invention in accordance with the volume of the fuel passages at the connecting point between the fuel passages from the high pressure feed pump and the common rail. The propagation of the pressure pulsation due to the discharged water hammer of the high pressure feed pump is suppressed by this. Also in this case, in a more concrete aspect, an orifice for throttling the flow of the fuel is used as the flow rate control means. Further, in another concrete aspect, a variable orifice comprising a differential pressure valve is used as the flow rate control means.

Where the fuel passages have a large total volume to a certain degree or more, the fuel passages as a whole perform the same action as that by the common rail for accumulating the high pressure fuel. Therefore, in another aspect of the accumulator fuel injection device of the present invention, irrespective of whether a tangible common rail is included or not, the flow rate control means for the purpose of suppressing the pressure pulsation due to the discharged water hammer of the high pressure feed pump or for the purpose of suppressing the pressure pulsation due to the injected water hammer of the fuel injectors is provided somewhere midway between the fuel passages connecting the high pressure feed pump and the fuel injectors. In both cases, what type of means is used as the flow rate control means is specially prescribed by the present invention such as was described before as the means for generating a flow rate of a magnitude specified in accordance with the volume of the fuel passages on the high pressure feed pump side or the fuel passages on the fuel injector side.

In the concrete aspect of the present invention, the flow rate control means is provided in at least one of the fuel passages on the oil accumulation chamber side branched from the fuel distribution passages upstream of the fuel injectors and the fuel passages on the control chamber side. This flow rate control means is set so as to generate a flow rate of a magnitude specified according to the present invention in accordance with the volume of the fuel passages. This then suppresses the generation and propagation of the pressure pulsation due to the injected water hammer of the fuel injectors or the water hammer accompanied the opening and closing of the electromagnetic valve for controlling the fuel pressure of the control chamber. Even where a pilot injection is carried out before the main injection, the pressure pulsation in the fuel passages on supply side with respect to the fuel injectors can be effectively suppressed. In a more concrete aspect, the flow rate control means is provided in the fuel passages on the oil accumulation chamber side, so that the generation of the pressure pulsation due to the injected water hammer of the fuel injectors is suppressed.

In this case as well, the flow rate control means includes an orifice as a fixed throttle for throttling the flow of the fuel or a valve as a variable throttle, and the pressure pulsation in the fuel passages is effectively suppressed corresponding to the pressure pulsation due to the injected water hammer etc. with an intensity which changes in accordance with the change of the operating condition. Further, the flow rate control means also can be provided with a function for balancing the distribution of the flow rates of the fuel to the fuel passages on the oil accumulation chamber side and the fuel passages on the control chamber side.

In a further aspect of the accumulator fuel injection device of the present invention, the role of distribution of the flow rates of fuel to the oil accumulation chamber side and the control chamber side can be given mainly to flow rate control means provided in the fuel passages near the branching portions. Further, in still another aspect, orifices having smaller diameters than the diameter of passage can be provided in the fuel passages downstream near the branching portions of the oil accumulation chamber so as to generate a clear throttle effect which is not the throttle effect naturally produced by the passage diameter.

BRIEF DESCRIPTION OF THE DRAWINGS

In the accompanying drawings.

DESCRIPTION OF THE PREFERRED EMBODIMENTS

Figure 1:
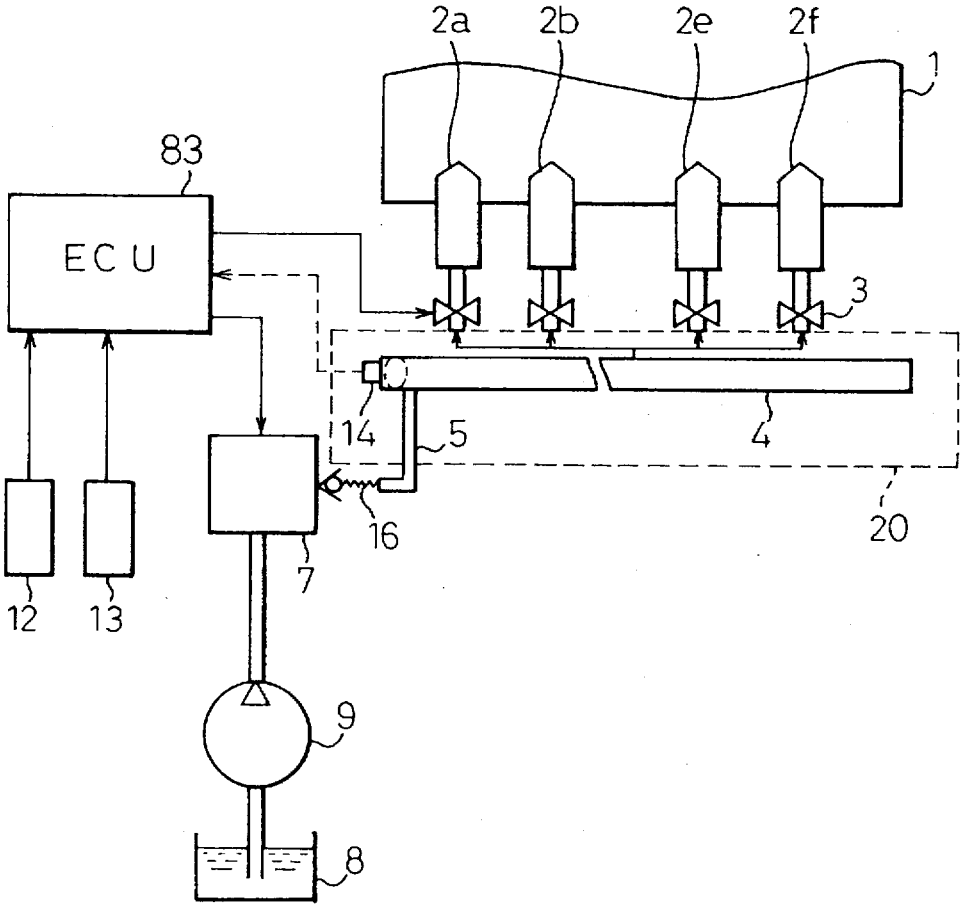
FIG. 1 is a conceptual view of the overall configuration of a first embodiment of the present invention.
Figure 2:
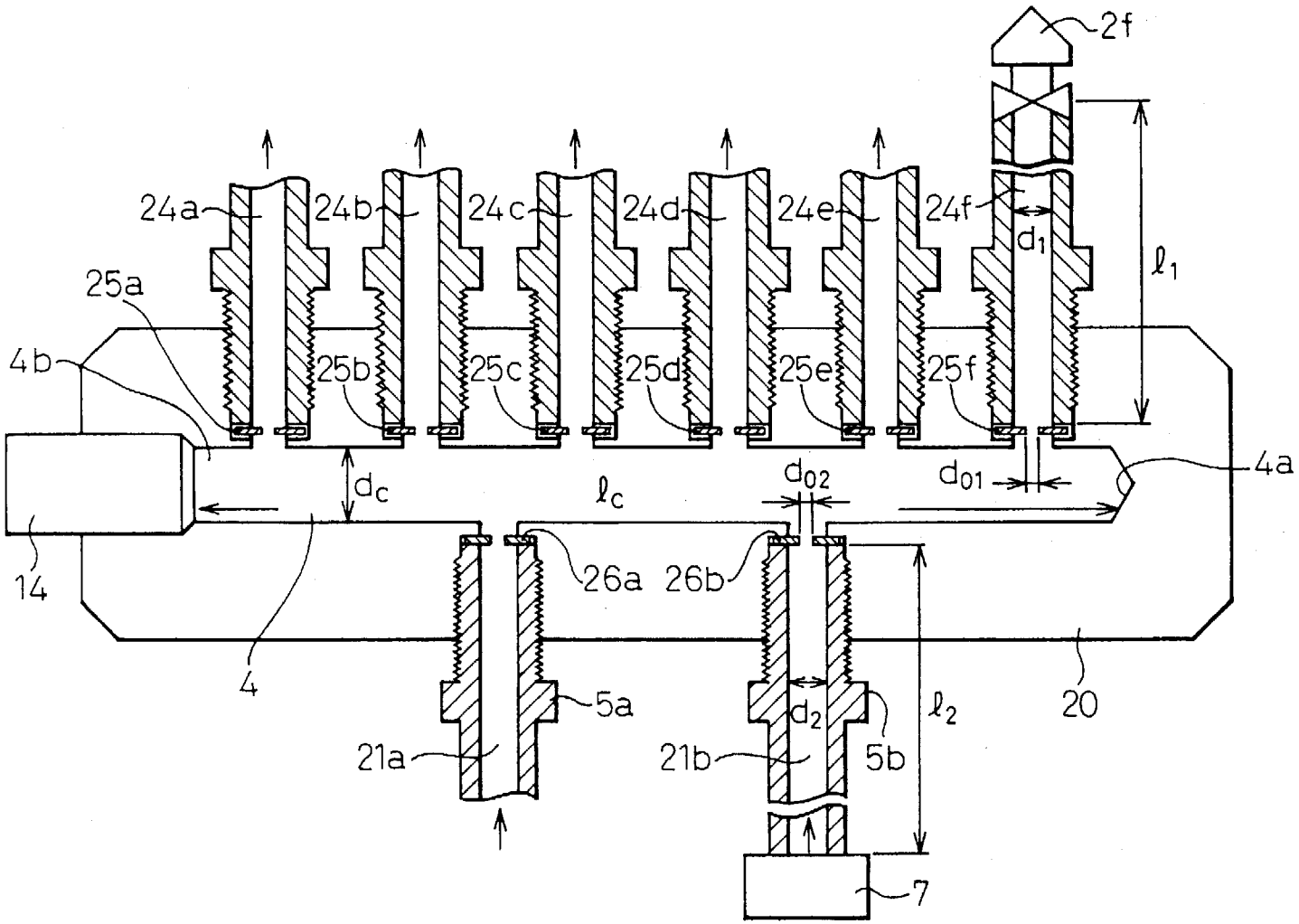
FIG. 2 is a sectional view of principal parts of the first embodiment.

A first embodiment obtained by applying the present invention to a fuel injection device for a six-cylinder diesel engine is shown in FIG. I and FIG. 2. In FIG. 1, fuel injectors (hereinafter referred to as "injectors") 2 are individually disposed corresponding to the plurality of cylinders in the diesel engine (hereinafter referred to as the "engine") 1. The injection of the fuel from the injectors 2 to the cylinders is controlled by the operation of injection control use electromagnetic valves 3.

The injectors 2 are connected to a high pressure accumulating pipe common to all of the cylinders, i.e., a so-called common rail 4. During the period where the injection control use electromagnetic valves 3 are opened, the fuel of the high pressure in the common rail 4 is injected from the injectors 2 into the cylinders of the engine 1. A predetermined high fuel pressure corresponding to the fuel injection pressure must be continuously stored in the common rail 4, therefore a high pressure feed pump 7 is connected through a feed pipe 5 and a discharge valve 16. This high pressure feed 7 pressurizes the fuel sucked in from a fuel tank 8 by a well known low pressure feed pump 9 to a high pressure to control and maintain the fuel in the common rail 4 at the high pressure.

An electronic control unit (ECU) 83 is used for controlling this system. This receives as input for example the information of the engine speed and load from an engine speed sensor 12 and a load sensor 13. The ECU 83 outputs a drive signal to the injection control use electromagnetic valves 3 to give the optimum fuel injection timing and fuel injection amount (injection period) determined in accordance with the operating state of the engine decided by these signals. Simultaneously, the ECU 83 outputs a control signal to the high pressure feed pump 7 to give the optimum value of injection pressure in accordance with the engine speed and load. The common rail 4 is also provided with a pressure sensor 14 for detecting the common rail pressure. The signal thereof is input to the ECU 83. The ECU 83 controls the discharge rate of the high pressure feed pump 7 so that the signal of the pressure sensor 14 becomes the optimum value set in accordance with the engine speed and load in advance.

As shown in FIG. 2, the common rail 4, which serves as a fuel accumulation passage having a relatively large diameter, is formed in a thick common rail housing 20 in the longitudinal direction of the housing. One end 4*a* of the common rail 4 is closed. The other end 4*b* is opened toward the outside. The pressure sensor 14 is screwed onto this opening. Fuel passages 21*a* and 21*b* are formed by the fuel supply pipes 5 connected to the high pressure feed pump 7, in this case two pipes 5*a* and 5*b*, so that they intersect with the longitudinal direction of the common rail 4. Similarly fuel passages 24*a*, 24*b*, 24*c*, 24*d*, 24*e*, and 24*f* are formed for supplying the fuel to the injectors 2*a*, 2*b*, 2*c*, 2*d*, 2*e*, and 2*f*.

Corresponding to the characteristic feature of the present invention, in the first embodiment, orifices 25*a* to 25*f* for controlling the flow rate of the fuel occurring due to the fuel injection from the injectors 2*a* to 2*f* are formed at points where the six fuel passages 24*a*, 24*b*, 24*c*, 24*d*, 24*e* and 24*f* and the common rail 4 are connected.

Further, at the point where the fuel passages 21*a* and 21*b* and the common rail 4 are connected, orifices 26*a* and 26*b* for controlling the flow rate occurring due to the fuel discharge from the high pressure feed pump 7 are formed.

Here, when assuming that the passage diameters d, and passage lengths $l_1$ of the six fuel passages 24*a* to 24*f* are all the same and also the passage diameters $d_2$ and passage lengths $l_2$ of the two passages 24*a* and 24*b* are the same, when the passage diameter of the common rail 4 is defined as $d_c$ and the passage length is defined as $l_c$, the orifice diameter $d_{01}$ is set for the orifices 25*a* to 25*f* so that the ratio between the flow rate ($m^3/s$) occurring in the fuel passages 24*a* to 24*f* to which the orifices are connected and the flow rate ($m^3/s$) from the common rail 4 becomes the same as the ratio of the difference of the total fuel passage volume $V_r$ and the volume $V_1$ of the fuel passage 24 with respect to the total fuel passage volume $V_r$, that is:

$$V_r=6\pi d_1^2 l_1/4+\pi d_c^2 l_c/4+2\pi d_2^2 l_2/4$$

(where, $V_1$ in this case is $V_1=\pi d_1^2 l_1/4$).

Further, for the orifices 26*a* and 26*b*, the orifice diameter $d_{02}$ is set so that the ratio between the flow rate ($m^3/s$) occurring in the fuel passages 21*a* and 21*b* to which the orifices are connected and the outgoing flow rate ($m^3/S$) to the common rail 4 becomes the same as the ratio of the difference of the total fuel passage volume $V_r$ and the volume $V_2$ of the fuel passage 21 with respect to the total fuel passage volume $V_r$ (wherein, $V_2$ in this case is $V_2=\pi d_2^2 l_2/4$).

Figure 3:
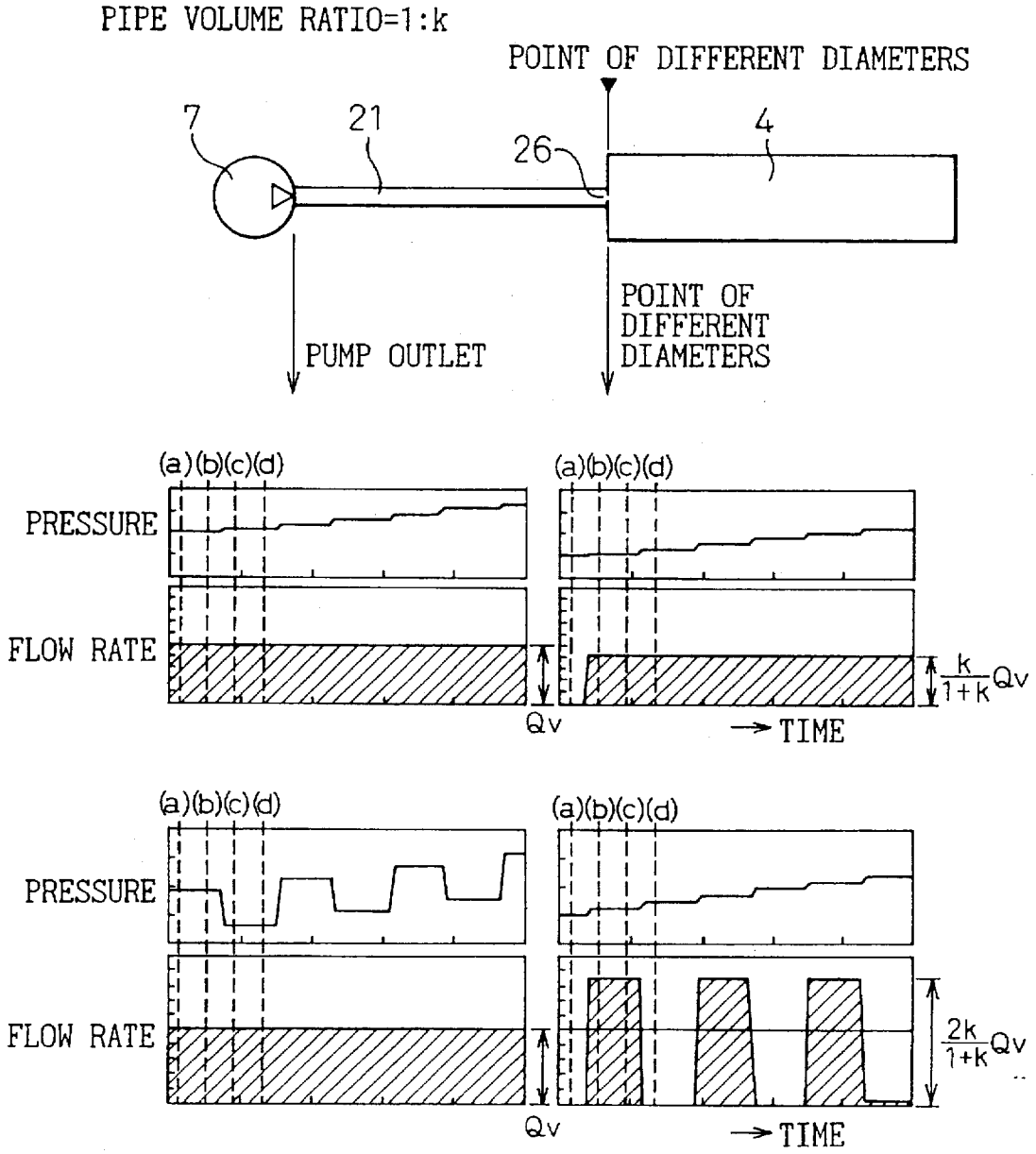
FIG. 3 shows the effect of the first embodiment of the present invention, in which the upper section is a conceptual view simply showing the first half of the configuration, the middle section is a timing chart showing the change of the pressure and flow rate thereof, and the lower section is a timing chart showing the change of the pressure and the flow rate in a related art for comparison.
Figure 4:
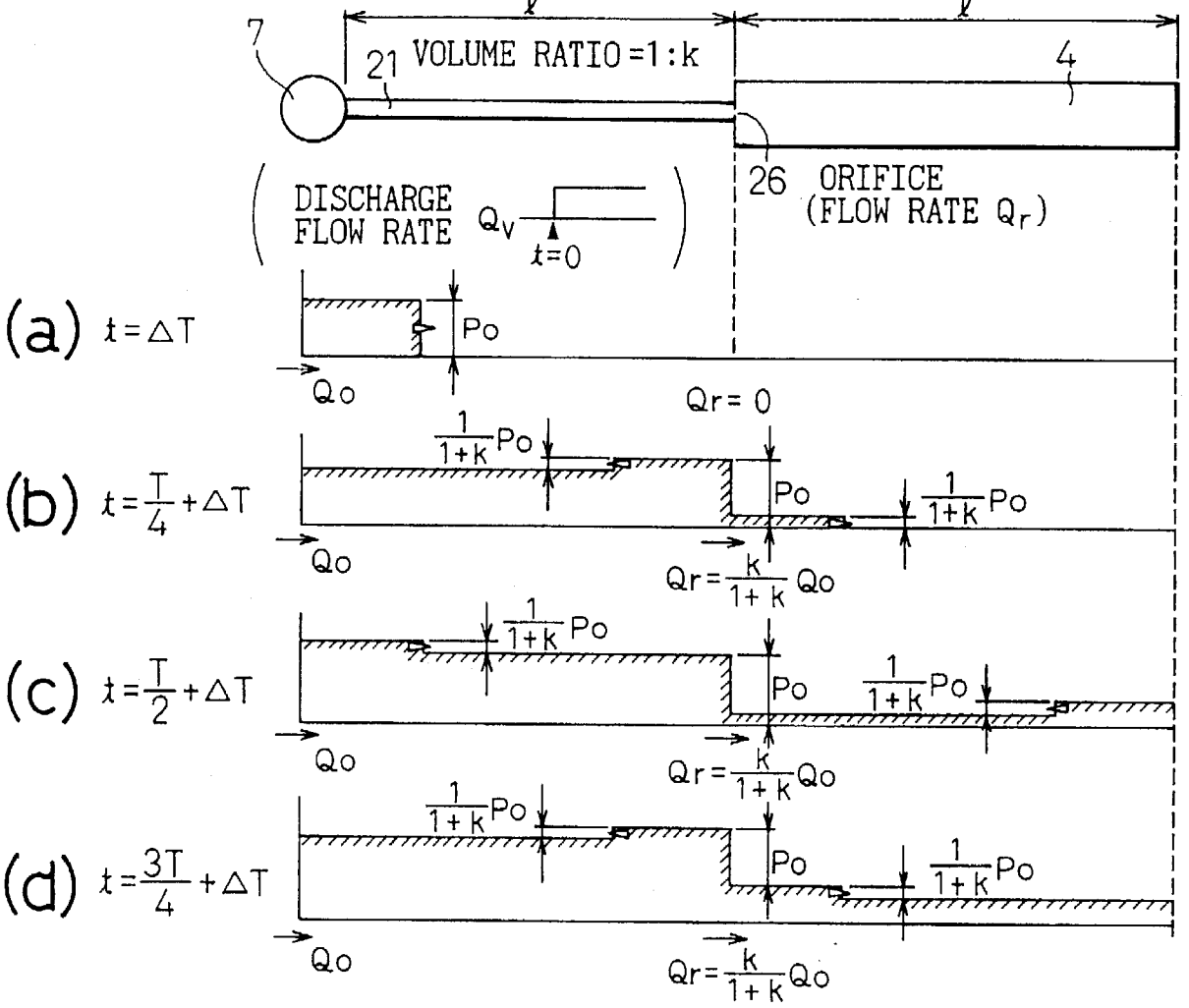
FIG. 4 is a timing chart showing the change of the pressure and the flow rate of the fuel in the fuel passages and the common rail when the discharge occurs from the high pressure feed pump.

Next, for explaining the operation by the configuration of the first embodiment, first, the action of reducing the pressure pulsation of the high pressure pump 7, which is the first half of the configuration, is shown in FIG. 3 and FIG. 4. The first half of the pipe configuration of the first embodiment is simplified as shown in the upper section of FIG. 3. It is assumed here that it comprises only the high pressure feed pump 7, fuel passage 21, orifice 26, and the common rail 4. In this simplified structure, it is assumed that the fuel passage length and the common rail length are equally I (letter 1), the sectional area of the fuel passage is 1 (one), and the sectional area of the common rail is k.

The change of the pressure and flow rate in the fuel passage 21 and the common rail 4 where the fuel discharge occurs from the high pressure feed pump 7 is shown in FIG. 4. When the fuel flows out from the high pressure feed pump 7 according to the discharge rate $Q_v$ determined according by the specifications of the pressure feed system in the high pressure feed pump, the flow rate of $Q_0=Q_v/1$ occurs in the fuel passage 21 since the sectional area of the fuel passage is 1.

In FIG. 4, when $t=\Delta T$, a pressure wave $P_0=\tau\cdot a\cdot Q_0$ in accordance with the flow rate $Q_0$ is generated in the fuel passage 21. Note, $\tau$ is the fuel density and a is the speed of sound. Here, it is assumed that the time for propagation of the pressure wave through a fuel passage having a length (=1) is T/4 and that the very short time $\Delta T<T/4$.

When $t=T/4+\Delta T$, the pressure wave due to the flow rate is propagated to the common rail 4 by the speed a of sound, but when it reaches the part of the orifice 26 which is the connection point with the common rail, the pressure wave is reflected. At this time, due to the orifice 26, the fuel of the flow rate $Q_r$ flowing into the common rail 4 is controlled to the flow rate $kQ_v/(1+k)$ in accordance with the ratio of difference of the total pipe volume and the fuel passage volume with respect to the total pipe volume. In this case, $Q_v>Q_r$, therefore, due to this reflection, a pressure wave of:

$$P_0/(1+k)=\{\tau akQ_v/(1+k)\}/k=\tau Q_v/(1+k)$$

is produced in the common rail and advances toward the closed end side of the common rail.

Further, in the fuel passage 21, a new flow rate change $Q_v/(1+k)$ is produced due to the flow rate $Q_v/(1+k)$ of the remainder of the fuel which could not flow out into the common rail 4, therefore the pressure wave is enlarged by exactly the amount of $P_0/(1+k)$ and advances toward the pump 7 side.

When $t=(2T/4)+\Delta T$, the pressure wave reflected at the common rail connection point is reflected again at the pipe ends and advances toward the connection point with the common rail together.

When $t=(3T/4)+\Delta T$, the pressure wave reaching the connection point with the common rail is reflected again, but the difference between the pressure before the orifice and the pressure after the orifice does not change from the initial condition (when $t=\Delta T$) and is $P_0$ as it is, so the flow rate of the fuel flowing into the common rail 4 does not change, but is maintained constant. Accordingly, whenever reflection of the pressure wave occurs, the pressure in the fuel passage 21 and the common rail 4 substantially uniformly rises according to the residual fuel passage flow rate $Q_v/(1+k)$, that is, the flow rate controlled by the orifice, and the amount $kQ_v/(1+k)$ of fuel flowing into the common rail, so no pressure pulsation is generated.

The change of the pressure at the outlet of the pump 7 and in the common rail 4 when the orifice is provided according to the present invention is shown as the waveform in the middle section of FIG. 3 by plotting time on the abscissa. As seen from this figure, by providing the orifice according to the present invention, the amount of fuel flowing into the common rail 4 does not fluctuate, and the pressure smoothly rises without being accompanied by pulsation.

Figure 5:
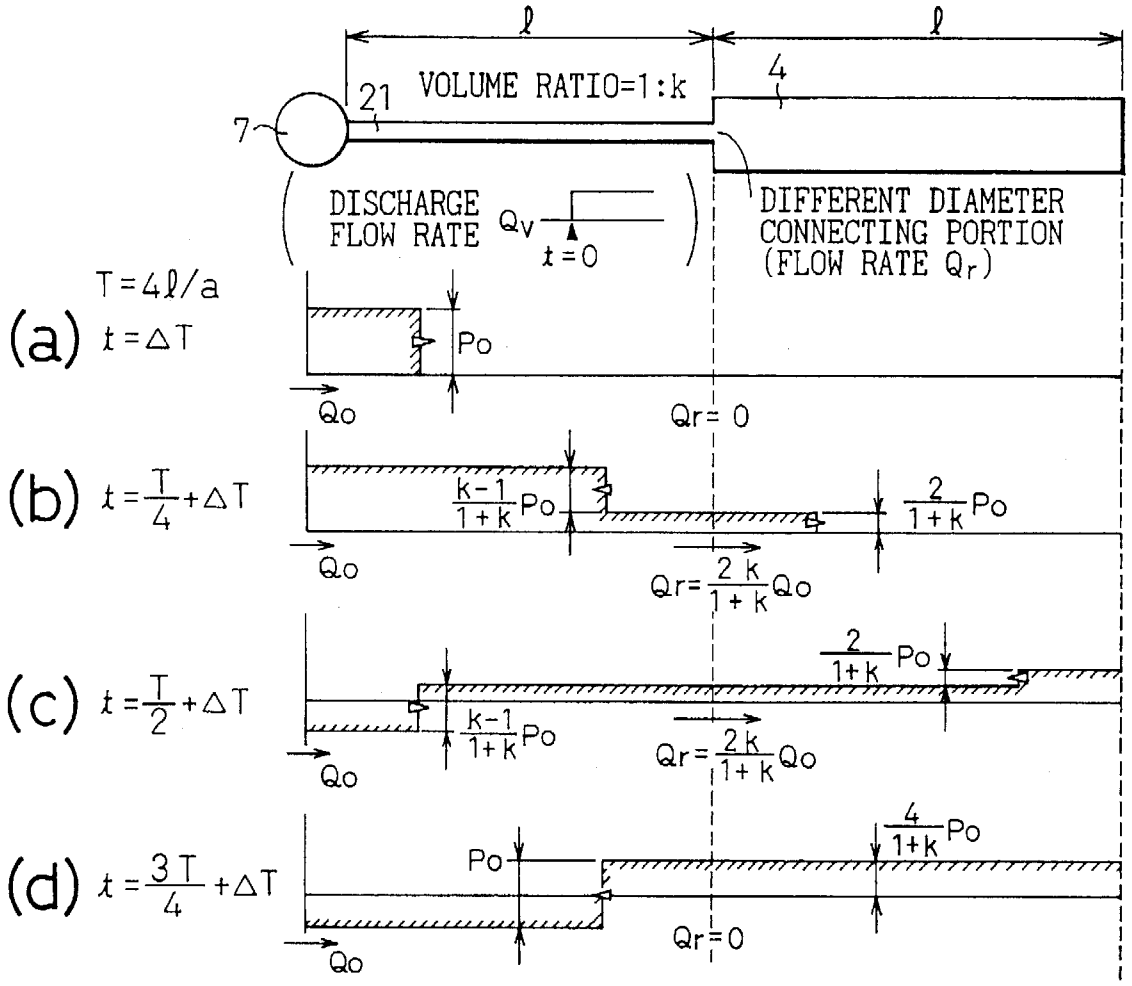
Fig.5 PRIOR ART
FIG. 5 is a timing chart showing the related art in comparison with FIG. 4.

An explanation will be made next of the change of the pressure in a conventional pipe in which an orifice for controlling the flow rate is not disposed as a comparison with the present invention by using FIG. 5. When $t=\Delta T$ immediately after the production of the fuel discharge Q, by the high pressure feed pump 7, similar to the case of the present invention, the pressure wave $P_0$ is generated by the flow rate $Q_0$ (m/s) occurring in the fuel passage 21 and is propagated to the common rail 4.

When the pressure wave reaches the connection point with the common rail 4 when $t=(T/4)+\Delta T$, since the sectional area of the passage is expanded, the amount $Q_r$($m^3$/s) of fuel flowing into the common rail 4 becomes equal to $Q_r=2kQ_v/(1+k)$ and the fuel of the flow rate $Q_v$($m^3$/s) or more in the fuel passage flows into the common rail 4. For this reason, in the common rail 4, a pressure wave in accordance with the incoming flow rate $Q_r$($m^3$/s):

$$\rho aQ_r/k=2\tau aQ_0/(1+k)=2P_0/(1+k)$$

is generated and advances toward the closed end of the common rail 4.

Similarly, in the fuel passage 21, the negative pressure wave of $P_0(k-1)/(1+k)$ is produced by the flow rate ($m^3$/s):

$$Q_v-Q_r=Q_v(1-k)/(1+k)<0$$

which becomes the amount of shortage due to the amount $Q_r$($m^3$/s) of fuel flowing into the common rail 4 with respect to the pump discharge rate $Q_v$($m^3$/s) and advances toward the high pressure feed pump 7.

When $t=(2T/4)+\Delta T$, the pressure wave is reflected again at the pipe ends and propagated to the connecting portion with the common rail 4, but when $t=(3T/4)+\Delta T$, the pressure difference at the connecting portion with the common rail 4 becomes 0, so the amount of fuel flowing into the common rail 4 becomes zero. The result of this is shown as the waveform at the lower section of FIG. 3 by plotting time on the abscissa. The pressure largely fluctuates simultaneously with the generation of an excess amount of flow of more than the discharge rate $Q_v$ from the high pressure feed pump 7 in the common rail 4; therefore a large pressure pulsation is produced in the fuel passage 21 on the pump side.

Figure 6:
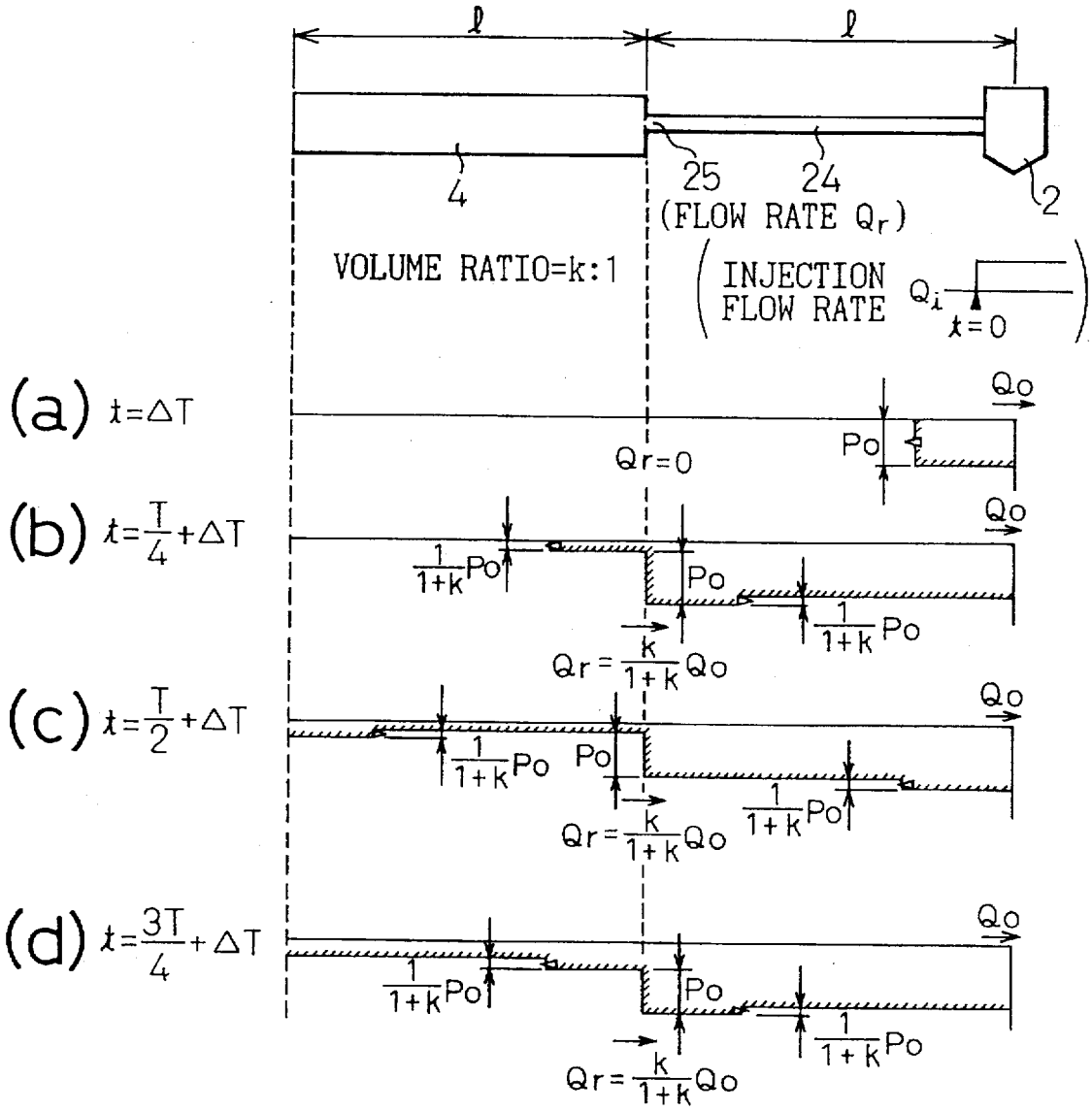
FIG. 6 shows the effect of the first embodiment, in which the upper section is a conceptual view simply showing the first half of the configuration and the lower section is a timing chart showing the change of the pressure and the flow rate thereof.

Next, an explanation will be made of the action of reduction of the pressure pulsation by the fuel injection from the injector 2 in the latter half of the configuration of the first embodiment by taking as an example a simplified structure of a pipe comprising the common rail 4, orifice 25, fuel passage 24, and the injector 2 as shown in FIG. 6. In this pipe configuration, it is assumed that the fuel passage length (m) and the common rail length (m) are equally 1 (letter l), the sectional area of the fuel passage 24 is 1 (one), and the sectional area of the common rail 4 is k.

A pressure wave $P_0=\tau\cdot a\cdot Q_0$ is generated by the flow rate $Q_0$ (m/s) in the fuel passage when the fuel injection is produced from the injector 2, that is, $Q_i/1$, and is propagated to the common rail 4. Note, the pressure wave in this case becomes a negative pressure wave since the fuel flows to the outside of the pipe. Then, when it reaches the orifice 258 which is the connecting point with the common rail 4, the fuel of the flow rate $kQ_i/(1+k)$ in accordance with the ratio of the difference between the total pipe volume and the volume of the fuel passage 24 with respect to the total pipe volume flows in from the common rail 4.

The rest of the action is the same as the case of the fuel discharge from the high pressure pump 7 mentioned before, but as shown in FIG. 7A and FIG. 7B, due to the action of controlling the flow rate of the orifice 25, both of the fuel in the common rail 4 and the fuel in the fuel passage 24 are uniformly reduced in pressure without the pressure pulsation.

Figure 8:
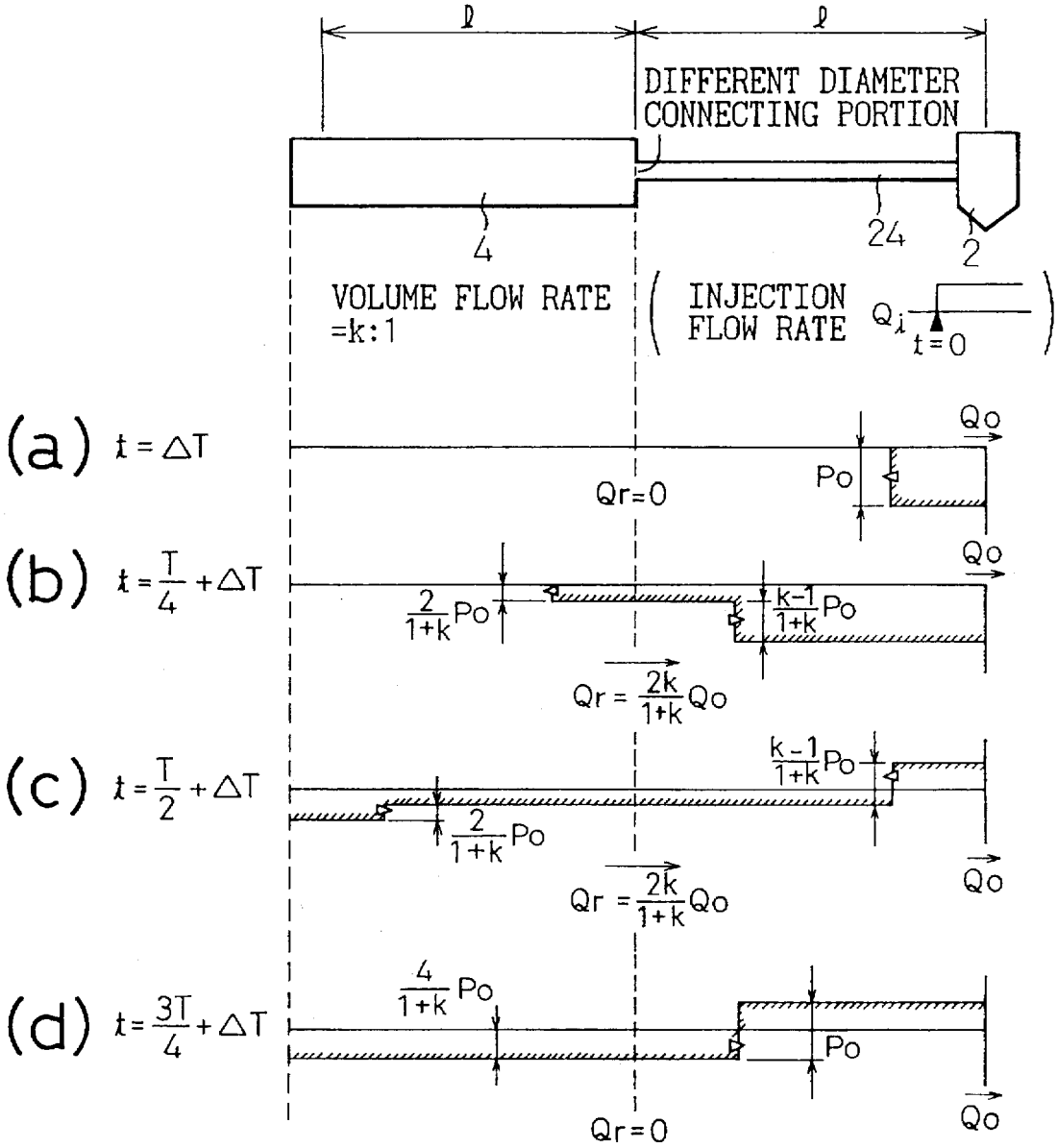
Fig.8 PRIOR ART
FIG. 8 is a timing chart showing the related art in comparison with FIG. 6.
Figure 9A:
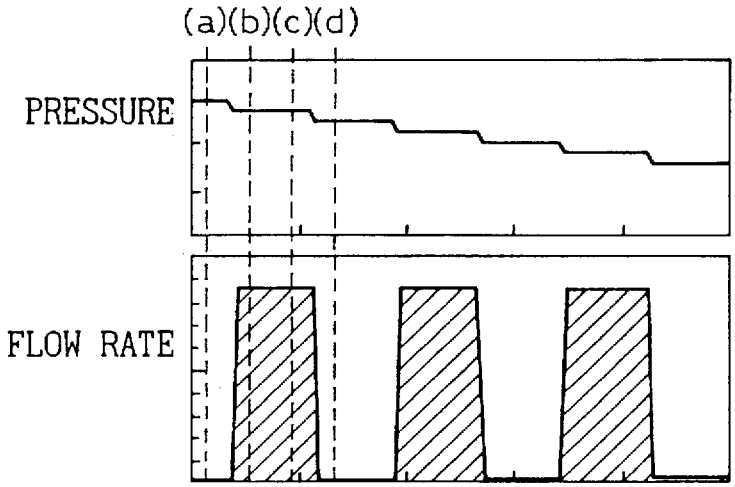
Fig.9A PRIOR ART
FIG. 9A is a timing chart showing the change of the pressure and the flow rate for the related art in comparison with FIG. 7A.
Figure 9B:
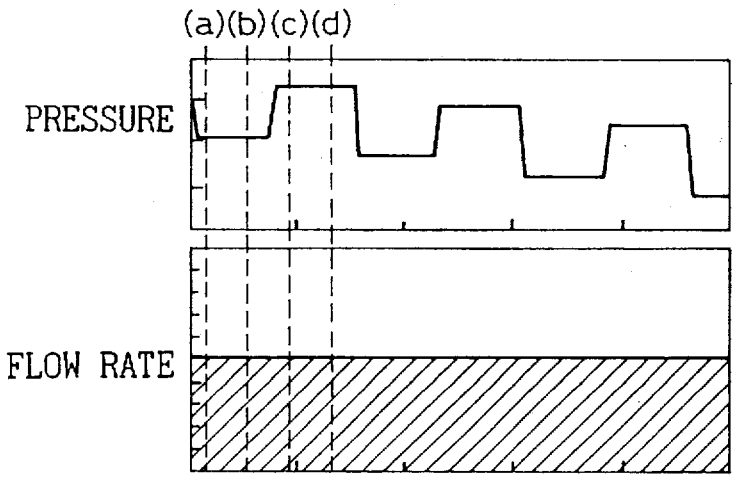
Fig.9B PRIOR ART
FIG. 9B is a timing chart showing the change of the pressure and the flow rate in comparison with FIG. 7B in the same case.

For comparison with this, the change of the pressure at the fuel injection of an injector in the related art is shown in FIG. 8, FIG. 9A, and FIG. 9B. No orifice is provided at the different-diameter connecting portion between the common rail and the fuel passage downstream thereof, so a large pressure pulsation is produced in the internal portion of the common rail and the fuel passage.

In the first embodiment of the present invention, the explanation was made assuming that there was only one of each of the fuel passages 21 and 24 and only one of each of the pump and injector, but even in a case where the engine comprises a plurality of pipes, injectors respectively provided in the plurality of cylinders, and the pump such as in the actual system shown in FIG. 1 and FIG. 2, the volumes of the parts other than the fuel passages connected to the injectors for injecting the fuel and the pump which pressurizes the fuel and discharge may be all considered as the common rail volume.

Figure 10:
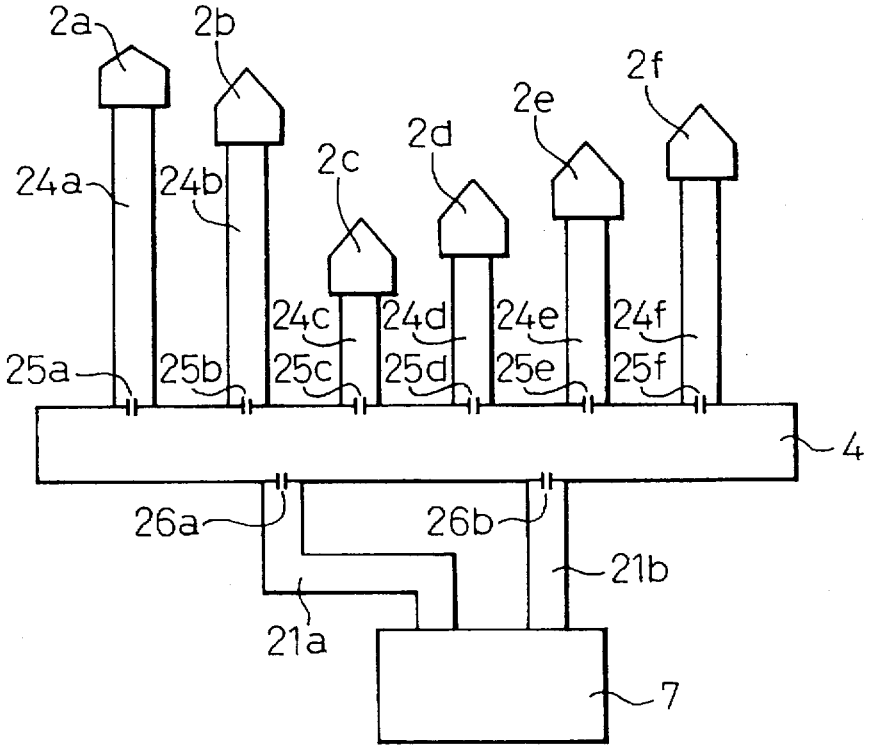
FIG. 10 is a conceptual view of the configuration of a modification of the first embodiment.

Further, as a modification of the first embodiment, the present invention can be applied also with respect to a case where the diameters or the lengths of the fuel passages connected to the injectors and the high pressure pump are different from each other. Namely, as shown in FIG. 10, when considering the case of the fuel passages 24*a* to 24*f* and 26*a* and 26*b* having different lengths from each other, in the case of the injector 2*a* having a longer passage length than those of passages with respect to the other injectors, with respect to the flow rate $Q_i$ produced in the fuel passage 24*a*, the orifice diameter of the orifice 25*a* may be determined so that the flow rate $Q_r$ of the fuel flowing from the common rail 4 via the orifice 25*a* becomes a value obtained by dividing the difference of the total pipe volume and the volume of the fuel passage 24*a* by the total pipe volume. That is, the orifice diameter is made larger for the orifice provided at the part to which a fuel passage having a short passage length or having a smaller diameter and small volume is connected. Conversely, the orifice diameter is made smaller for the orifice provided at the part to which a fuel passage having a long passage length or having a long diameter and large volume is connected.

Further, even in a case where the common rail 4 is not thicker than the fuel passage 24, but has the same diameter or is thinner than the latter, and in a case where the common rail 4 does not have the shape of a pipe but has a relatively large volume like a block, the orifice diameter may be determined from the volume of such a common rail. The present invention can be applied in both cases.

Figure 11:
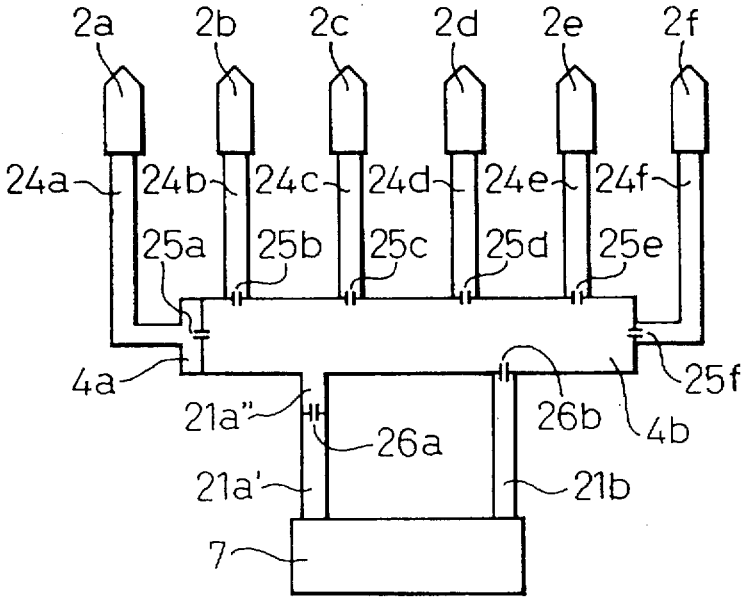
FIG. 11 is a conceptual view of the configuration of another modification of the first embodiment.

Note that, in the above embodiments, the explanation was made of the example where the orifice was disposed at the connecting point of the fuel passage and the common rail, but a similar effect is obtained even if the orifice is disposed in the middle of the pipe or in the common rail. As shown in FIG. 11, it is also possible to dispose the orifice 26*a* in the middle of the fuel passage 21*a*. In this case, the pipe volume of both sides of the orifice 26*a* is considered and the orifice diameter of the orifice 26*a* is determined so that fuel having a flow rate of the value obtained by dividing the difference between the total pipe volume and the volume of fuel passage 21*a*' by the total pipe volume among the flow rates occurring in the fuel passage 21*a*' upstream of the orifice due to the discharge of fuel of the high pressure pump 7 flows out to the fuel passage 21*a*" downstream.

Further, as another modification of the first embodiment, where the orifice is disposed inside the common rail 4 like the orifice 25*a* shown in FIG. 11, the pipe volume on both sides of the orifice 25*a* is considered and the orifice diameter of the orifice 25*a* is determined so that the fuel of the flow rate of the value obtained by dividing the total pipe volume minus the volume of the fuel passage 24 and the volume of the common rail 4*a* by the total pipe volume among the flow rates occurring in the fuel passage 24*a* due to the fuel injection of the injector 2*a* flows into one part of the common rail 4*a*.

In the first embodiment and partial modifications of the same, the explanation was made while using orifices having a fixed diameter. However, if the common rail pressure or the engine speed changes due to the change of the operating conditions of the engine, the fuel injection rates from the injectors 2 and the fuel discharge rate from the high pressure feed pump 7 change, so it is difficult to precisely control the flow rate from the common rail or the flow rate to the common rail to always match with the pipe volume ratio by fixed orifices.

That is, by taking as an example fuel discharge from the high pressure feed pump 7, the high pressure feed pump is driven by the rotation force of the engine, so that accompanied with the rise of the engine speed, the rotation speed of the high pressure pump also rises. Due to this, the oil feed rate of the pressure feed system in the high pressure pump rises, and as a result the pressure wave $P_0$ is increased. However, it is well known that the flow rate from the orifice is proportion to a ½ power of the differential pressure $P_0$ between the pressure before the orifice and the pressure after the orifice. For this reason, when the pump speed rises, the rate of fuel flowing out to the common rail side becomes smaller than the flow rate determined according to the ideal volume ratio and the effect of reducing the pressure pulsation is reduced.

Considering such a problem, a mechanism in which the volume ratio can be controlled even in a case where the operating conditions of the engine (pump speed, common rail pressure) change is shown in FIGS. 12A to 12C and FIGS. 13A to 13C as a second embodiment. In the part shown in FIG. 12A and FIG. 12B, a variable orifice serving as a differential pressure valve, comprised of a ball 28 which can partially close a grooved opening of a valve seat 27 and which is resiliently supporting by a spring 30 and a spring seat 31 via a ball receiver 29 from the downstream side, is disposed at the connecting point between the fuel passage 21 from the high pressure pump and the common rail 4. In the part shown in FIG. 13A and FIG. 13B, a variable orifice serving as a differential pressure valve having a similar structure is disposed at the connecting point of the fuel passage 24 communicated with the injector and the common rail 4.

Figure 12A:
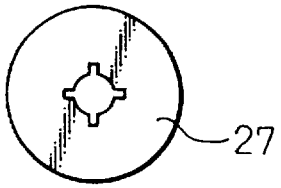
FIG. 12A is a side sectional view of the principal parts of the first half of a second embodiment of the present invention.
Figure 12B:
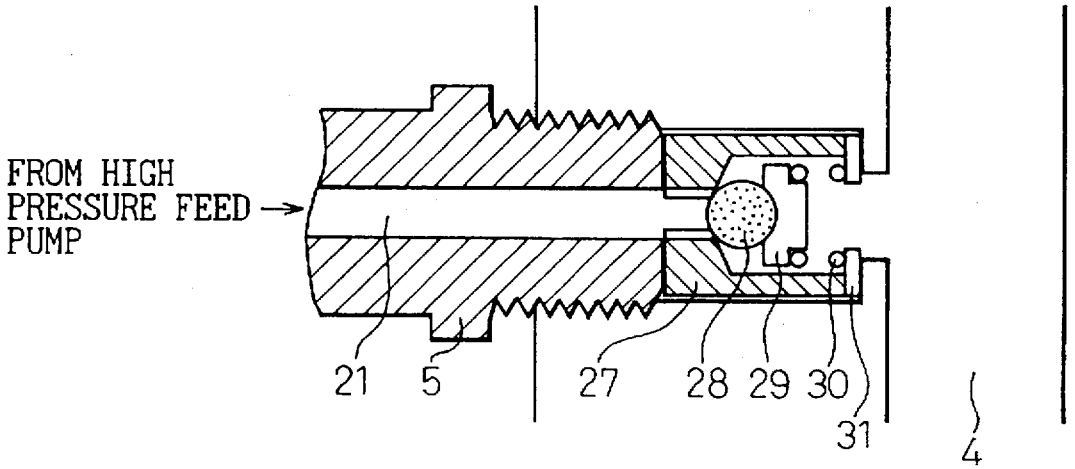
FIG. 12B is a vertical sectional view of the principal parts in the same case.
Figure 12C:
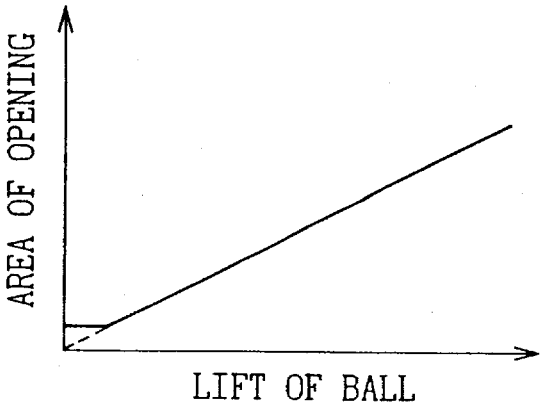
FIG. 12C is a graph showing the operation of the principal parts in the same case.
Figure 13A:
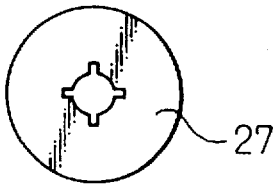
FIG. 13A is a side sectional view showing the principal part of the latter half of the second embodiment of the present invention.
Figure 13B:
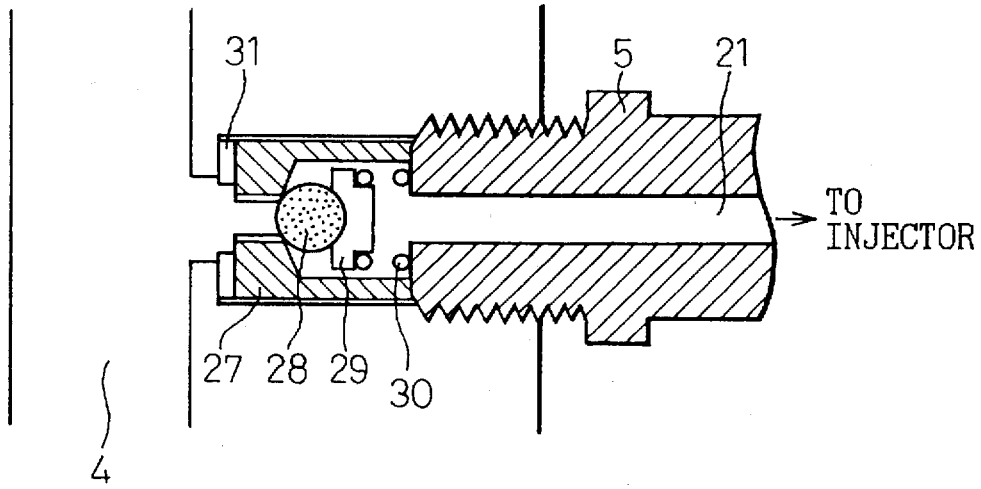
FIG. 13B is a vertical sectional view of the principal parts in the same case.
Figure 13C:
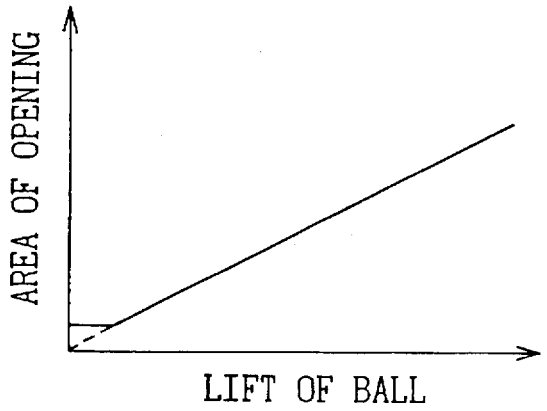
FIG. 13C is a graph showing the operation of the principal parts in the same case.

In both cases, along with the rise of the discharge rate of the high pressure pump and the injection rate of the injector, the pressure wave $P_0$ generated in the fuel passage is increased, therefore the lift, i.e., the movement of the ball 28 serving as the valve element with respect to the valve seat 27 downstream, changes due to the pressure wave $P_0$. In other words, the difference between the pressure before the connecting point and the pressure after the connecting point, and the communicated surface area of the orifice changes as shown in FIG. 12C and FIG. 13C in accordance with the lift. Due to this, even if the discharge rate of the high pressure pump and the injection rate of the injector change, the throttle rate of the variable orifice, that is, the differential pressure valve, changes, and so can always give the optimum effect of suppressing the pressure wave.

Figure 14:
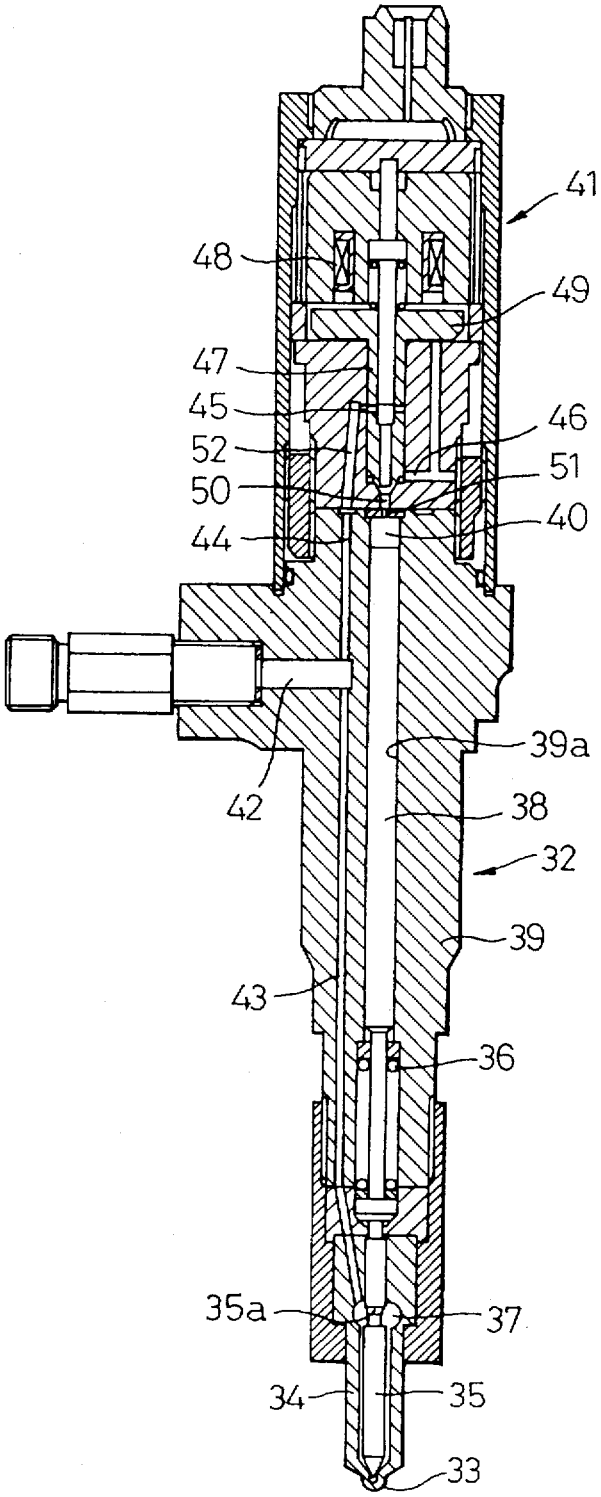
Fig.14 PRIOR ART
FIG. 14 is a vertical sectional front view illustrating a conventional three-way valve type injector.

Next, an explanation will be made of a third embodiment of the present invention. First, among the problems of the related art, concerning particularly the latter problem, that is, the problem of the pressure pulsation due to the injection water hammer when fuel of a high pressure is injected from the fuel injector, a conventionally well known three-way valve type injector is shown in FIG. 14. In FIG. 14, the three-way valve type injector 32 is provided with a nozzle 34 having an injection port 33 and a needle 35 for opening and closing the injection port 33. The needle 35 is constantly biased in a direction for closing the injection port 33 by the needle spring 36. At the same time, the step portion 35*a* of the needle 35 is biased to a direction for opening the injection port 33, that is, upward, by the pressure of fuel of the high pressure in the oil accumulation chamber 37.

The upper end of the needle 35 is in contact with the lower end of the piston rod 38 extending upward on the same axial line, so when the piston rod 38 moves downward, the needle 35 is pushed down and moves in a direction for closing the injection port 33. In the body 39, a control chamber 40 is formed as a space at the top of the cylinder 39*a* which slidingly receives the piston rod 38. The piston rod 38 is driven downward in accordance with the pressure of the fuel introduced into the control chamber 40. For moving the piston rod 38, the pressure of the fuel of the control chamber 40 is controlled by the three-way electromagnetic valve 41.

Although not shown in FIG. 14, part of the fuel of the high pressure accumulated in the common rail while being pressurized by the high pressure feed pump is supplied to the inlet passage 42 of the three-way valve type injector 32, that is, part of the injection pipe. The inlet passage 42 is branched to two directions: one communicated with the fuel passage 43 in the body 39 which guides the high pressure fuel to the upstream side of the injection port 33 via the oil accumulation chamber 37 and the other communicated with the supply port 45 of the three-way electromagnetic valve 41 by the fuel passage 44 in the body 39. The discharge port 46 of the three-way electromagnetic valve 41 is continuously connected to the low pressure fuel tank.

The valve needle 47 of the three-way electromagnetic valve 41 is integrally formed with an armature 49 driven by a solenoid 48. According to the position of the valve needle 47 in the vertical direction, that is, whether the solenoid 48 is electrically biased, the low pressure of the discharge port 46 or the high pressure of the supply port 45 is selectively communicated with the connection port 50 and the fuel pressure of the connection port 50 is guided to the control chamber 40 via the orifice 51, whereby the pressure of the control chamber 40 changes. By the movement of the needle 35 in the vertical direction by that pressure up to the position where the force for pressing down the piston rod 38 and the fore for pressing down the needle spring 36 acting upon the same direction balance with the upward force by the fuel pressure of the oil accumulation chamber 37 acting upon the step portion 35*a* of the needle 35, the injection port 33 can be opened and closed.

In such a three-way valve type injector 32, when the injection port 33 is opened for only a relatively short time and so-called pilot injection for injecting a small amount of fuel is performed before the main injection at which the injection port 33 is relatively largely opened by the needle 35, as mentioned before, pressure pulsation is generated in the control chamber 40 and the oil accumulation chamber 37 by the water hammer (discharged water hammer) at the time of pilot injection as mentioned before, so there is a problem that the pattern of the injection amount and the injection rate at the main injection for injecting a large amount of fuel becomes unstable.

In order to solve this problem, in the related art, a plurality of fuel passages 52 are provided on the control chamber side for connecting the fuel passage 44 and the supply port 45 to promote the attenuation of the pressure pulsation in the control chamber 40, but the attenuation of the pressure pulsation is not sufficient when the interval of the pilot injection and the main injection is short, so the above problem cannot be completely solved. Further, no countermeasure is taken for the fuel passage 43 on the oil accumulation chamber side, so the pulsation of the fuel pressure acting upon the oil accumulation chamber 37 cannot be reduced.

The present invention provides a fuel injector of an accumulator fuel injection device disclosed in the following embodiments as a means for solving the above problems.

The basic overall configuration of the third embodiment of the present invention in the case of application to a fuel injection device for a six-cylinder diesel engine is similar to that of the first embodiment previously explained as shown in FIG. 1, so overlapping explanations will be omitted here.

FIG. 15 shows the configuration of the principal parts of the third embodiment of the present invention applied to a three-way valve type injector as in the related art (FIG. 14) mentioned before. The same reference numerals or symbols are give to structural parts substantially the same as those of the conventional example shown in FIG. 14 and detailed explanations of the same will be omitted. Namely, in the three-way valve type injector 52 of the characteristic feature of the accumulator fuel injection device of the third embodiment, 38 denotes a piston rod for driving the needle, 39 a body, 39*a* a cylinder formed in the body 39 for the piston rod 38, 40 a control chamber, 41 a three-way electromagnetic valve 42 an inlet passage communicated with the common rail 4 as shown in FIG. 2 as part of the injection pipe, 43 a fuel passage on the oil accumulation chamber side, 44 a fuel passage on the control chamber side, 45 a supply port of the three-way electromagnetic valve 41, 46 a discharge port, 47 a valve needle, 48 a solenoid, 49 an armature, 50 a control port, and 51 an orifice.

Figure 15A:
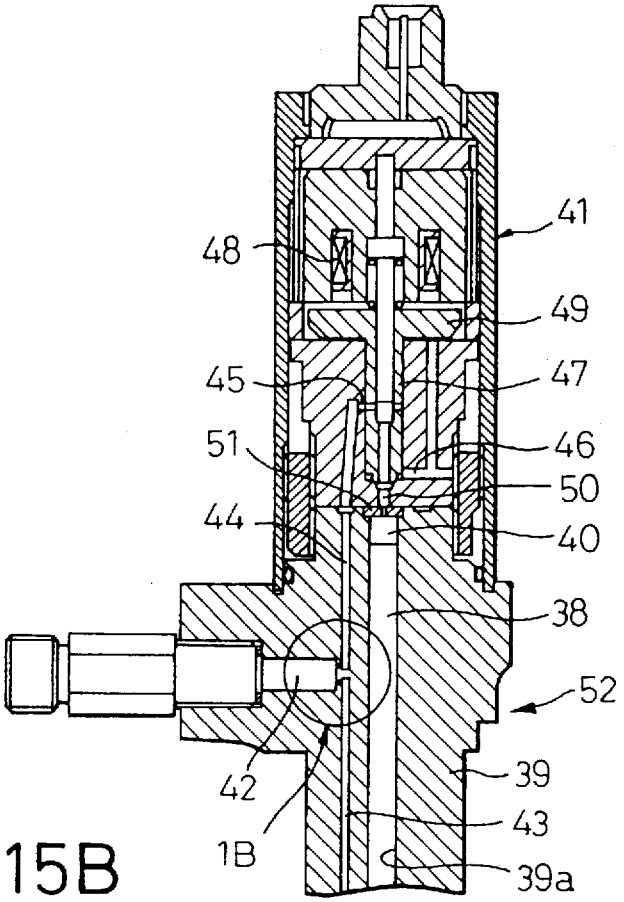
FIG. 15A is a vertical sectional front view of the injector of the principal part of a third embodiment of the present invention.
Figure 15B:
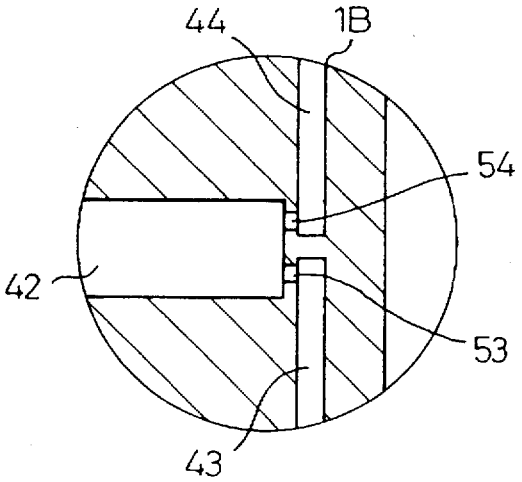
FIG. 15B is an enlarged sectional view of one part thereof in the same case.

The characteristic feature of the third embodiment resides in that, as clear from FIG. 15B showing part of FIG. 15A, that is, the circled part (branch portion 1B), in an enlarged manner, a first orifice 53 and second orifice 54 are separately provided at the position branching from the inlet passage 42 with respect to the three-way valve type injector 52 to the fuel passage 43 on the oil accumulation chamber side and the fuel passage 44 on the control chamber side. In this case, the diameter of the second orifice 54 is set so that the ratio of the flow rate ($m^3/s$) occurring in the fuel passage 44 on the control chamber side and the flow rate ($m^3/s$) of the second orifice 54 when the three-way electromagnetic valve 41 is electrically biased and operates becomes:

$$V_r: V_t - V_a$$

where $V_t$ is defined as the total volume of the high pressure pipe and, at the same time, $V_a$ is defined as the volume of the fuel passage 44 on the control chamber side. Note that, in claims 10 and the following claims, the same technical contents are expressed from another viewpoint.

Further, the diameter of the first orifice 54 is set so that the ratio of the flow rate ($m^3/s$) of the injected fuel produced in the fuel passage 43 on the oil accumulation chamber side and the flow rate ($m^3/s$) of the first orifice 53 becomes:

$$V_r: V_t - V_b$$

when the three-way valve type injector 32 opens and the fuel is injected from the injection port where the volume of the fuel passage 43 on the oil accumulation chamber side is defined as $V_b$. Note that, in claims 10 and 11, the same technical contents are expressed from another viewpoint.

Figure 16:
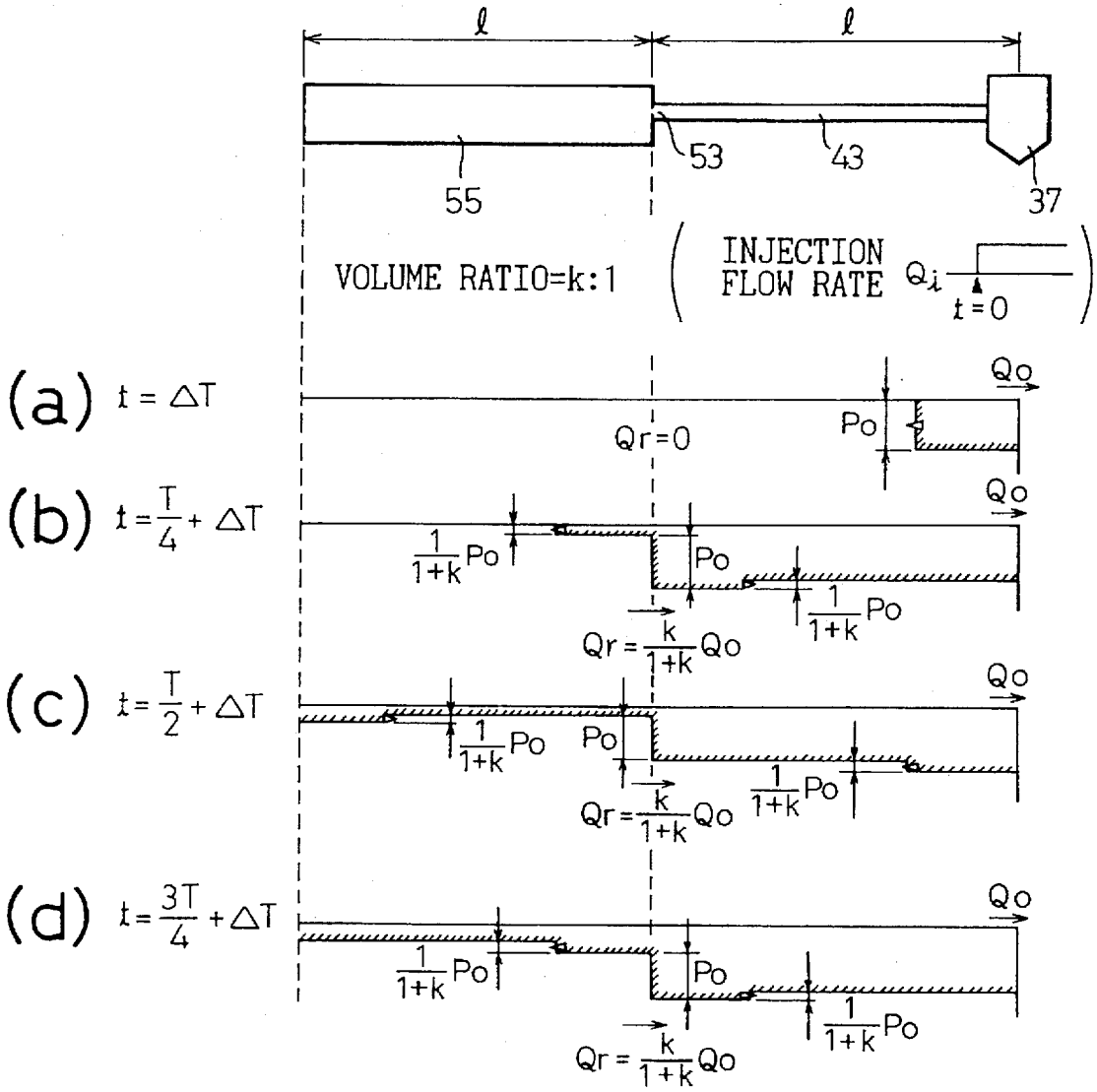
FIG. 16 shows the effect of the third embodiment, in which the upper section is a conceptual view simply showing the system configuration and the lower section is a timing chart showing the change of the pressure and the flow rate thereof.

Next, an explanation will be made of the action of reducing the pressure pulsation by the fuel injection from the three-way valve type injector 52 of the third embodiment. As shown in FIG. 16, which shows the simplified configuration of the pipe in this case, when the ratio of the volume of all pipes 55 including the common rail 4 (refer to FIG. 1) storing the high pressure fuel supplied from the high pressure feed pump 7 but excluding the fuel passage 43 on the oil accumulation chamber side and the volume of the fuel passage 43 on the oil accumulation chamber side is k : 1, when the pilot injection is started, a pressure wave in accordance with the flow rate $Q_0$:

$$P_0=\rho\cdot a\cdot Q_0/A$$

is generated in the fuel passage 43 on the oil accumulation chamber side. Note, ρ is the density, a is the speed of sound, and A is the sectional area of the passage.

Figure 7A:
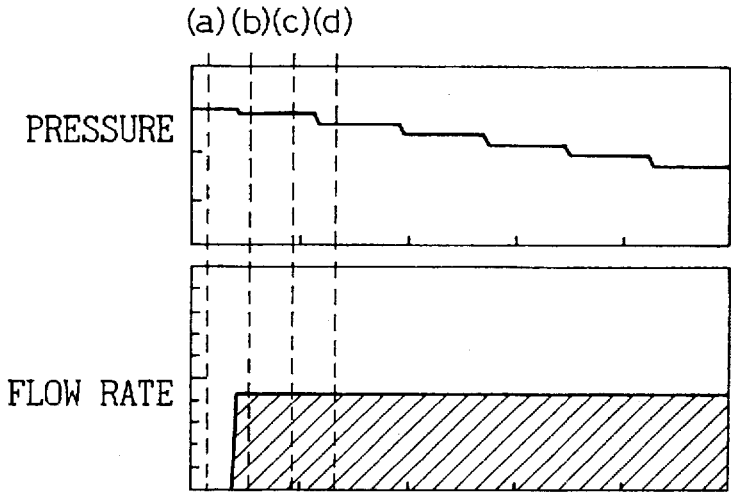
FIG. 7A is a timing chart showing the change of the pressure and the flow rate in the common rail in the case shown in FIG. 6.
Figure 7B:
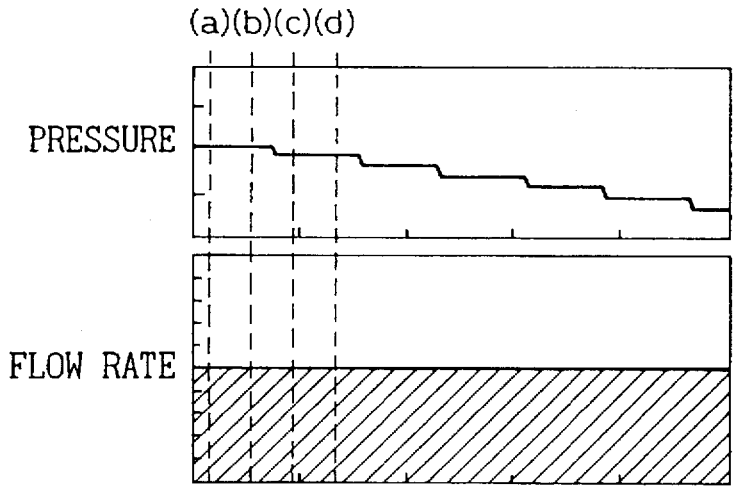
FIG. 7B is a timing chart showing the change of the pressure and the flow rate in the fuel passages downstream from the common rail in the same case.

The pressure wave P., is propagated in the passage at the speed of sound and when reaching the first orifice 53, is reflected. At this time, the flow rate of the high pressure fuel passing through the first orifice 53 is controlled to the flow rate $kQ_0/(1+k)$ in accordance with the volume ratio of the pipes, and the reflection wave $P_0/(1+k)$ is produced in all of the pipes 55 except the passage 43 on the oil accumulation chamber side and the passage on the oil accumulation chamber side. Such a reflection is repeatedly caused later, but the difference between the pressure before the first orifice 53 and the pressure after the first orifice 53 is held at the constant value $P_0$, so the flow rate of the high pressure fuel passing through the orifice 53 is held constant as it is and the entire pressure relatively smoothly falls similar to the case previously shown in FIGS. 7A and 7B in relation to the first embodiment; therefore no pressure pulsation is produced in the oil accumulation chamber 37 etc. Note, in this case, FIG. 7A shows the side upstream of the orifice 53, and FIG. 7B shows the side downstream of the orifice 53. Accordingly, the first orifice 53 has a great effect for stabilizing the injection amount and injection rate at the time of the pilot injection and the main injection.

Contrary to this, where the first orifice 53 is not provided in the fuel passage 43 on the oil accumulation chamber as in the conventional case, as shown in FIG. 8, FIG. 9A, and FIG. 9B, the flow rate of the high pressure fuel at the connecting portion of the passage 43 on the oil accumulation chamber side and all of the pipes 55 except the passage 43 on the oil accumulation chamber side largely fluctuates. A large pressure pulsation is generated in the oil accumulation chamber 37 etc. accompanied with this, therefore the pattern of the injection amount and injection rate at the time of the pilot injection and main injection becomes unstable. (Note, in FIG. 8, 2 should be read as 37, 4 should be read as 55, and 24 should be read as 43).

Also the function of the second orifice 54 (refer to FIGS. 15A and 15B) provided on the control chamber side is substantially the same. By providing the orifice 54 in the fuel passage 44 on the control chamber side, the flow rate of the high pressure fuel passing through the orifice 54 is held constant and the generation of the pressure pulsation in the control chamber 40 can be effectively suppressed. Note that, in the third embodiment, an example of use of a fixed throttle as the first orifice 53 and the second orifice 54 is shown, but in the present invention, it is also possible to use flow rate control means of another form achieving a similar throttle function as these orifices.

Figure 17A:
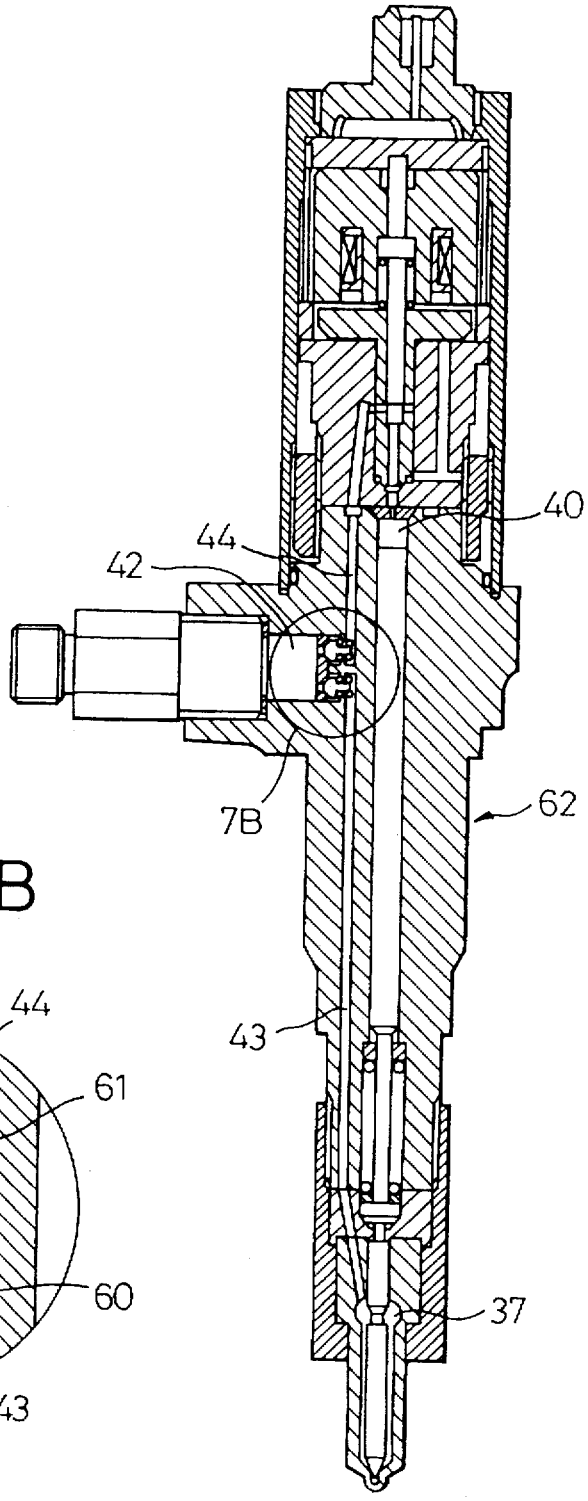
FIG. 17A is a vertical sectional front view of the injector of a principal part of a fourth embodiment of the present invention.
Figure 17B:
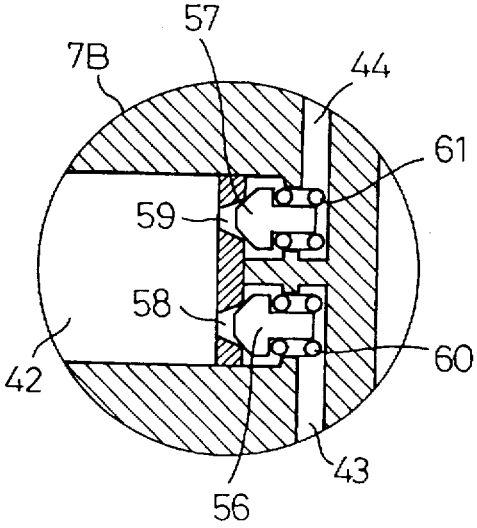
FIG. 17B is an enlarged sectional view of one part of the same.

The configuration of the principal parts of the fourth embodiment of the present invention is shown in FIG. 17A and in FIG. 17B, which is an enlarged view of the principal parts thereof (branch portion 7B). The characteristic feature of the fourth embodiment resides in that a first valve element 56 and a second valve element 57 with opening degrees which change in accordance with the oil pressure of the high pressure fuel passing through these parts are used as the flow rate control means in place of the first orifice 53 and the second orifice 54 in the third embodiment, and a so-called variable throttle is formed by them.

The valve elements 56 and 57 take the form of needle valves provided in the passage 43 on the oil accumulation chamber side and the fuel passage 44 on the control chamber side. Both of them use throttle openings 58 and 59 like the orifices 53 and 54 in the third embodiment as the valve seats and are biased in the direction for closing the openings from the downstream side by springs 60 and 61. Accordingly, in accordance with the oil pressure of the high pressure fuel upstream of the throttle openings 58 and 59, the valve elements 56 and 57 separate from the throttle openings 58 and 59, thereby forming the variable throttles.

In this case as well, things are set so that the flow rates of the high pressure fuel produced by the valve elements 56 and 57 give a predetermined ratio. Namely, taking the first valve element 56 as an example, when fuel of a high pressure is injected from the injection port 33 of the three-way valve type injector 62 of the fourth embodiment, the surface area of the throttle opening 58 and the weight of the spring 60 are set so that the ratio of the flow rate produced in the passage 43 of the oil accumulation chamber side and the flow rate produced in the flow rate control means, that is, the throttle opening 58 of the first valve element 56, becomes equal to the ratio of the total volume of the high pressure pipes, i.e., the injection pipes, and a value obtained by subtracting the volume of the passage 43 on the oil accumulation chamber side from the total volume of the high pressure pipes.

Figure 18A:
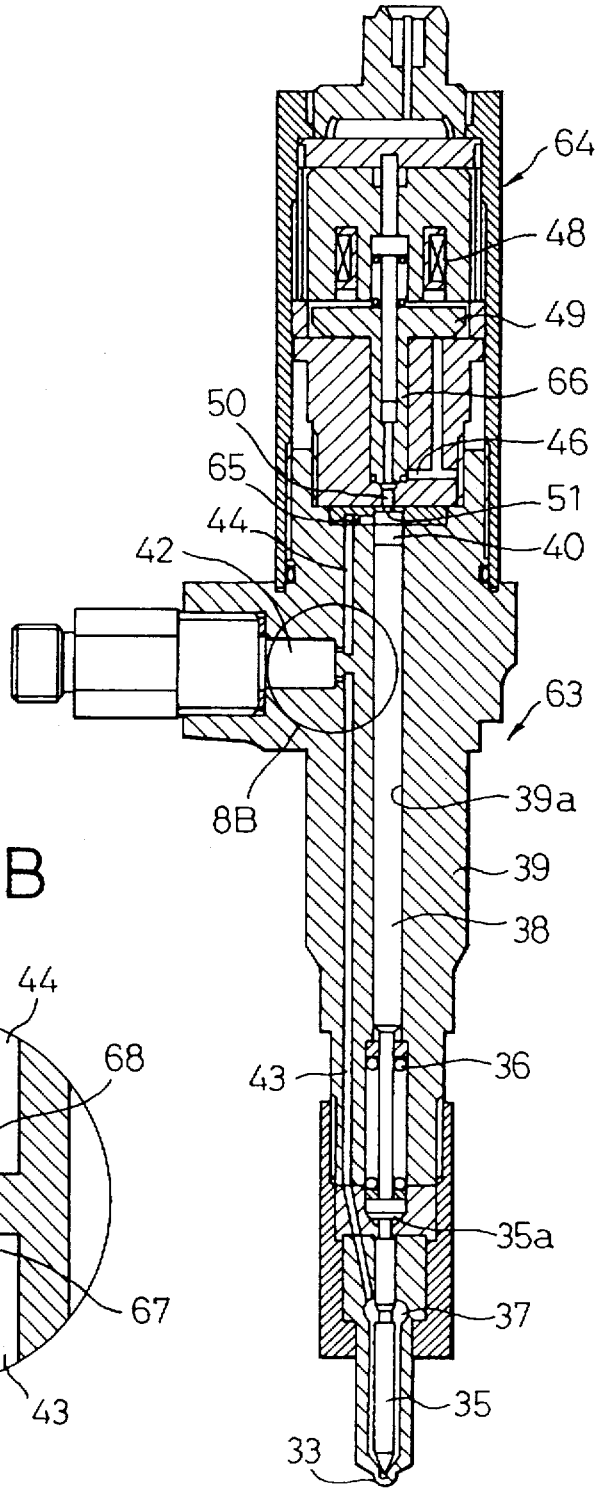
FIG. 18A is a vertical sectional front view of the injector of a principal part of a fifth embodiment of the present invention.
Figure 18B:
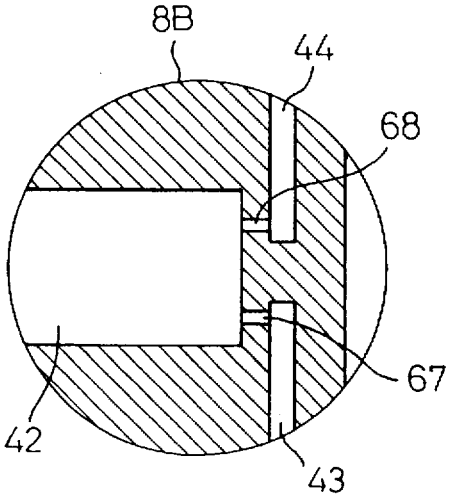
FIG. 18B is an enlarged sectional view of one part thereof in the same case.

The configuration of the principal parts of the fifth embodiment of the present invention is shown in FIG. 18A and in FIG. 18B, which is an enlarged view of the principal parts thereof (branch portion 8B). The difference of the fifth embodiment from the third embodiment resides in that a two-way type injector 63 is used in place of the three-way valve type injector 52; that is, a two-way electromagnetic valve 64 is used in place of the electromagnetic valve for injector control. In general, a two-way valve type injector per se is well known, so a detailed explanation is not required. The same reference symbols or numerals will be given to substantially the same structural parts as those of the above three-way valve type injector 52 or 62, and only different points will be explained below.

The fuel passage 44 on the control chamber side of the two-way valve type injector 63 is directly communicated with the control chamber 40 by an orifice 65 having a small opening diameter irrespective of the operation of the two-way electromagnetic valve 64. The valve needle 66 of the two-way electromagnetic valve 64 can open and close the portion between the connection port 50 communicating with the control chamber 40 and the discharge port 46 via the orifice 51 similar to the case of the three-way valve type injector 52 etc. Accordingly, when the solenoid 48 is electrically biased and the valve needle 66 is lifted together with the armature 49, the connection port 50 and the discharge port 46 are communicating with each other and the pressure of the fuel of the control chamber 40 is lowered, so the needle 35 opens by the force by the pressure of the high pressure fuel acting upon the oil accumulation chamber 37 and the fuel is injected from the injection port 33. Further, when the solenoid 48 is not biased, the outflow of the high pressure fuel from the connection port 50 to the discharge port 46 is shut off, so the fuel pressure of the control chamber 40 rises up to the same height as that of the high pressure fuel of the inlet passage 42, the piston rod 38 and the needle 35 are pushed down and close the injection port 33, and the fuel injection from the injector 63 stops.

In the case of the fifth embodiment as well, similar to the third embodiment, as shown in FIG. 18B as an enlarged view, the characteristic feature resides in that the first orifice 67 and the second orifice 68 are provided as the flow rate control means provided in the part for distributing the high pressure fuel to the fuel passage 43 on the oil accumulation chamber side and the fuel passage 44 on the control chamber side from the inlet passage 42 receiving the supply of the high pressure fuel via the common rail 4 (refer to FIG. 1) from the high pressure feed pump 7. Further, also in this case, the opening diameters of the orifices 67 and 68 are set so that the flow rates of the high pressure fuel produced by them give the predetermined ratio mentioned above. Namely, taking the first orifice 67 as an example, the surface area of the opening of the orifice 67 is set so that when fuel of a high pressure is injected from the injection port of the injector 63, the ratio of the flow rate produced in the passage 43 on the oil accumulation chamber side and the flow rate produced in the flow rate control means, that is, the first orifice 67, becomes equal to the ratio of the total volume of the high pressure pipes and the value obtained by subtracting the volume of the passage 43 on the oil accumulation chamber side from the total volume of the high pressure pipes.

Note that, it is sufficient so far as the orifices 67 and 68 are provided at the parts near the branch portion 8B of the fuel passages 43 and 44; therefore, it is not always necessary to provide these two flow rate control means concentrated at the branch point per se from the inlet passage 42 to the two fuel passages 43 and 44 as in FIGS. 18A and 18B showing the fifth embodiment. Further, it is also possible to replace the orifices 67 and 68 which are fixed throttles by variable throttles like the valve elements 56 and 57 shown in FIG. 17B similar to the case of the fourth embodiment.

Figure 19A:
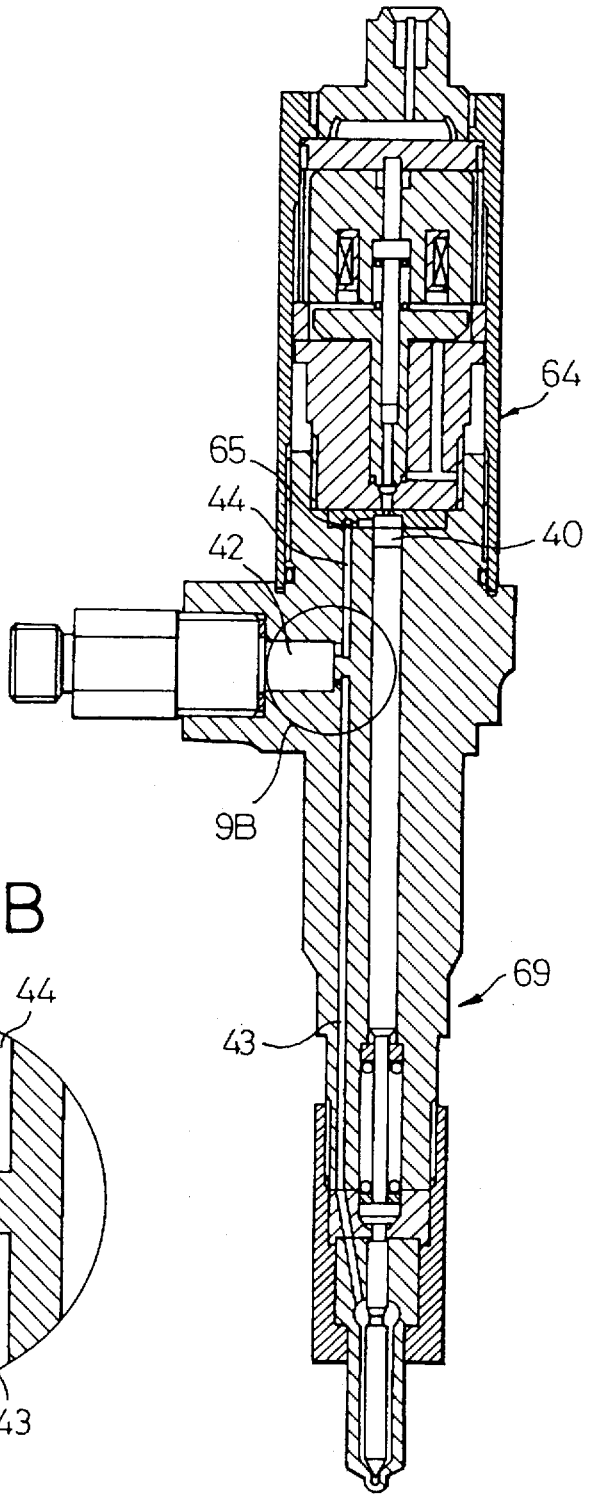
FIG. 19A is a vertical sectional front view of the injector of a principal part of a sixth embodiment of the present invention.
Figure 19B:
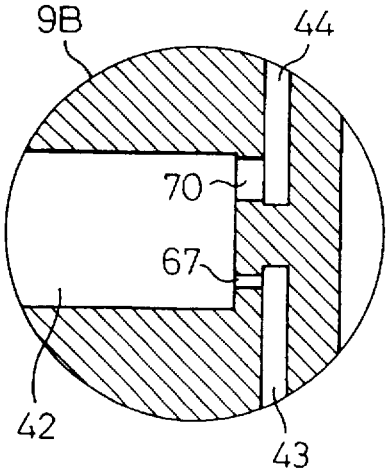
FIG. 19B is an enlarged sectional view of one part of the same.

The configuration of the principal parts of the sixth embodiment of the present invention is shown in FIG. 19A and in FIG. 19B which is an enlarged view of the principal parts thereof (branch portion 9B). The injector 69 in this embodiment is also a two-way valve type similar to the fifth embodiment and the fuel pressure of the control chamber 40 is controlled by the two-way electromagnetic valve 64. The characteristic feature of the sixth embodiment with respect to the fifth embodiment shown in FIGS. 18A and 18B resides in the fact that the first orifice 67 is provided in the fuel passage 43 on the oil accumulation chamber side as the flow rate control means, but nothing corresponding to the second orifice 68 is provided, and the fuel passage 44 on the control chamber side is substantially never throttled in the passage part 70 near the branch portion from the inlet passage 42.

In the sixth embodiment, no member like the second orifice 68 in the fifth embodiment is provided in the passage part 70 of the fuel passage 44 on the control chamber side because the second orifice 68 in the fifth embodiment is supplementary, since a member like the orifice 65 is conventionally generally provided between the fuel passage 44 on the control chamber side and the control chamber 40. Therefore, the second orifice 68 can be omitted when the pressure pulsation in the control chamber 40 is a relatively low level.

Figure 20A:
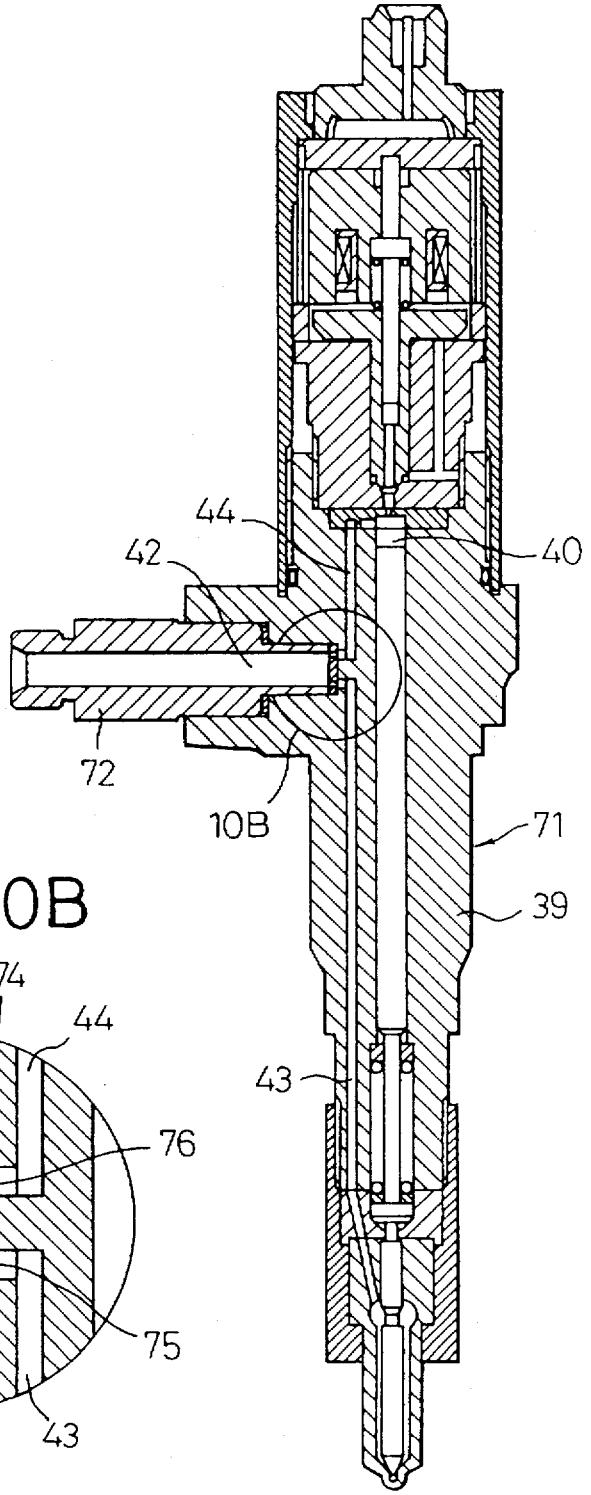
FIG. 20A is a vertical sectional front view of the injector of a principal part of a seventh embodiment of the present invention.
Figure 20B:
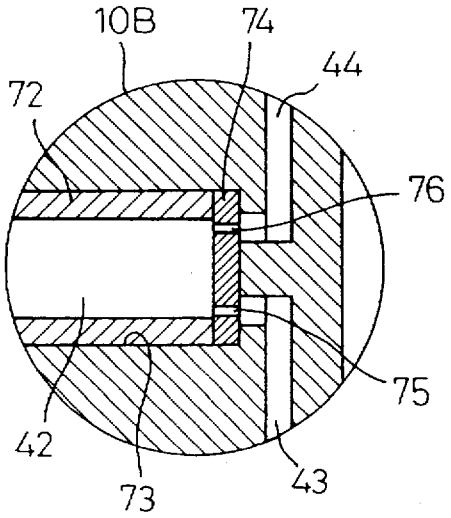
FIG. 20B is an enlarged sectional view of one part of the same.

The configuration of the seventh embodiment of the present invention is shown in FIG. 20A and in FIG. 20B, which is an enlarged view of the principal parts thereof (branch portion 10B). The seventh embodiment illustrates a preferred concrete structure of the flow rate control means including an orifice as a fixed throttle. In this example, the part of the inlet passage 42 is formed inside an end 72 of the connector which is affixed inserted into the body 39 of the injector 71 and, at the same time, the first orifice 75 and the second orifice 76 are provided in a disk-like member 74 attached to the bottom of the hole 73 on the body 39 side so as to come into contact with the end 72 and are communicating with the fuel passage 43 on the oil accumulation chamber side and the fuel passage 44 on the control chamber side. According to the seventh embodiment, there is an advantage that it becomes possible to easily and highly precisely fabricate the orifices 75 and 76 serving as the flow rate control means. Note that, an appropriate turnstop is given to the disk-like member 74 to hold the communication state between the orifices 75 and 76 and the fuel passages 43 and 44.

Figure 21A:
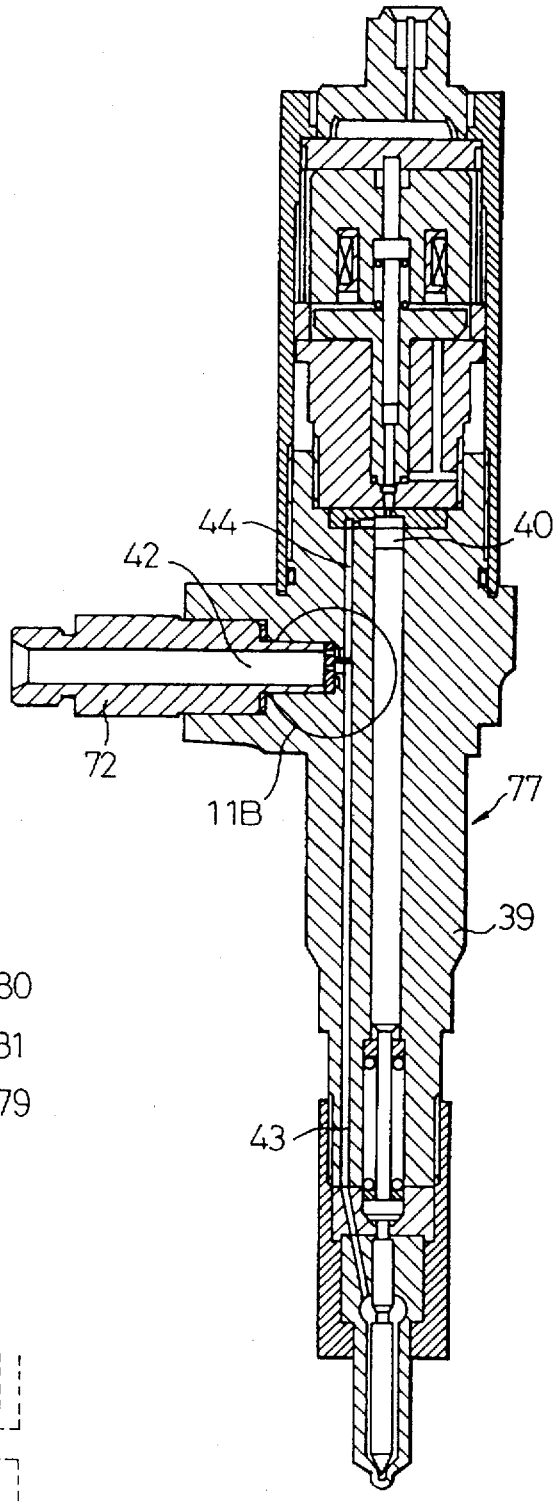
FIG. 21A is a vertical sectional front view of the injector of a principal part of an eighth embodiment of the present invention.
Figure 21B:
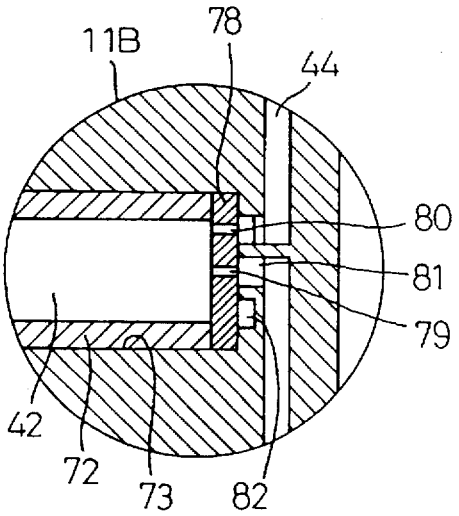
FIG. 21B is an enlarged sectional view of one part of the same.
Figure 21C:
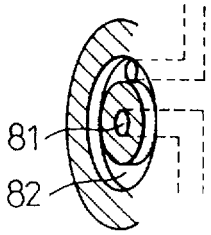
FIG. 21C is a perspective view of one part of the same.

In the injector 77 in the eighth embodiment of the present invention shown in FIG. 21A and in FIGS. 21B and 21C, which are enlarged views of the principal parts thereof (branch portion 11B), similar to the case of the seventh embodiment, an inlet passage 42 is formed by the end 72 of a tubular connector separate from the body 39 of the injector and, at the same time, orifices 79 and 80 are formed on a disk-like member 78 similar to the member 74, but, as the characteristic feature of the eighth embodiment, the first orifice 79 is opened at the center of the disk-like member 78, and, at the same time, the second orifice 80 is opened at the part close to the circumferential edge. A center opening 81 matching with the first orifice 79 is provided at the center of the bottom of the hole 73 to always communicate between the inlet passage 42 and the fuel passage 43 on the oil accumulation chamber side. At the same time, a circular groove 82 is formed on the periphery of the center opening 81 in the bottom surface of the hole 73 and the groove 82 is always communicating with the fuel passage 44 on the control chamber side so that the second orifice 80 Is always communicating with the fuel passage 44 on the control chamber side even if the disk-like member 78 rotates.

By such a structure as the eighth embodiment, even if a turnstop is not given to the disk-like member 78, the corresponding communication state between the orifices 79 and 80 and the fuel passages 43 and 44 is reliably held. Needless to say, the positional relationship of the first orifice 79 and the second orifice 80 on the disk-like member 78, that is, the positioning as to which orifice is provided at the center and which is provided near the circumferential edge, may also be reversed. Further, in the seventh embodiment and the eighth embodiment, the disk-like member 74 or 78 of the separated body is made to abut against the end 72 of the connector, but, needless to say, they can be integrally formed by making the disk-like member the bottom of the end 72 of the connector.

We claim:

1. An accumulator fuel injection device for an engine having one or more cylinders comprising:

a fuel injector provided for every cylinder of the engine;

a common rail for accumulating pressurized fuel to be supplied to the fuel injector;

a high pressure feed pump for supplying high pressure fuel to the common rail;

a fuel distribution passage connecting the common rail and the fuel injector;

a fuel supply passage connecting the common rail and the high pressure feed pump; and a flow rate controller provided in at least one of the fuel supply passage, the common rail, the fuel distribution passage, and a passage inside the fuel injector, wherein the flow rate controller controls the flow rate through the flow rate controller to have a ratio, with respect to the flow rate of the fuel through the fuel injector, equal to a value obtained by dividing a difference between a total pipe volume and the volume of the distribution passage between the flow rate controller and the fuel injector by the total pipe volume, wherein the total pipe volume is the sum of the volume of the common rail and volumes of all the distribution passages and supply passages.

2. An accumulator fuel injection device for an engine having one or more cylinders comprising:

a fuel injector provided for every cylinder of engine;

a common rail for accumulating pressurized fuel to be supplied to the fuel injector;

a high pressure feed pump for supplying a high pressure fuel to the common rail;

a fuel distribution passage connecting the common rail and the fuel injector; and a fuel supply passage connecting the common rail and the high pressure feed pump; and a flow rate controller provided at a connecting point of the fuel distribution passage and the common rail, wherein the flow rate controller controls the flow rate through the flow rate controller to have a ratio, with respect to the flow rate of the fuel through the common rail, equal to a value obtained by dividing a difference between a total pipe volume and the volume of the distribution passage by the total pipe volumes, wherein the total pipe volume is the sum of the volume of the common rail and volumes of all the distribution passages and supply passages.

3. An accumulator fuel injection device for an engine having one or more cylinders according to claim 1, wherein the flow rate controller comprise's an orifice.

4. An accumulator fuel injection device for an engine having one or more cylinders according to claim 1, wherein:

the flow rate contoller comprises a differential pressure valve with a valve element and with an opening area which increases along with the amount of displacement of the valve element and the valve element displaces to the distribution passage side due to an increase of a pressure wave produced in the distribution passage accompanying an increase of the injection pressure in the fuel injector.

5. An accumulator fuel injection device for an engine having one or more cylinders, comprising:

a fuel injector provided for every cylinder of the engine;

a common rail for accumulating pressurized fuel to be supplied to the fuel injector;

a him pressure feed pump for supplying high pressure fuel to the common rail;

a fuel distribution passage for communicating between the common rail and the fuel injector;

a fuel supply passage connecting the common rail and the high pressure feed pump; and a flow rate controller provided at a connecting point of the fuel supply passage and common rail, wherein the flow rate controller controls the flow rate trough the flow rate controller to have a ratio, with respect to the flow rate of the fuel through the supply passage, equal to a value obtained by dividing a difference between a total pipe volume and the volume of the supply passage by the total pipe volume, wherein the total pipe volume is the sum of the volume of the common rail and volumes of all the distribution passages and supply passages.

6. An accumulator fuel injection device for an engine having one or more cylinders according to claim 5, wherein the flow rate controller comprises an orifice.

7. An accumulator fuel injection device for an engine having one or more cylinders according to claim 5, wherein:

the flow rate controller comprises a differential pressure valve with a valve element and with an opening area which increases along with the amount of displacement of the valve element: and the valve element displaces to the common rail side due to the increase of a pressure wave produced in the supply passage accompanying an increase of the drive speed of the high pressure feed pump.

8. An accumulator fuel injection device for an engine having one or more cylinders, comprising:

a fuel injector provided for every cylinder of the engine;

a high pressure feed pump which supplies a high pressure fuel to a fuel injector;

a fuel passage for connecting the fuel injector and the high pressure feed pump via a connecting portion or branch portion; and a flow rate controller provided in the middle of the fuel passage;

wherein the flow rate controller controls the flow rate though the flow rate controller to have a ratio, with respect to the flow rate of fuel through the high pressure feed pump equal to a value obtained by dividing; a difference between the volume of all fuel passages and the volume of the fuel passage from the high pressure feed pump to the flow rate controller by the volume of all fuel passages.

9. An accumulator fuel injection device for an engine having one or more cylinders, comprising:

a fuel injector for every cylinder of the engine;

a high pressure feed pump which supplies a high pressure fuel to the fuel injector;

a fuel passage for connecting the fuel injector and the high pressure feed pump via a connecting portion or branch portion; and a flow rate controller provided in the middle of fuel passage;

wherein the flow rate controller controls the flow rate through the flow rate controller to have a ratio, with respect to the flow rate through the fuel injector, equal to a value obtained by dividing a difference between the volume of all fuel passages and the volume of the fuel passage from the fuel injector to the flow rate controller by the volume of all fuel passages.

10. An accumulator fuel injection device for an engine having one or more cylinders, comprising:

a fuel injector provided for every cylinder of the engine;

a common rail for accumulating pressurized fuel to be supplied to the fuel injector;

a high pressure feed pump for supplying a high pressure fuel to the common rail;

a fuel distribution passage for connecting the common rail and the fuel injector;

a fuel supply passage connecting the common rail and the high pressure feed pump;

an oil accumulation chamber for biasing a needle toward a valve opening position by the fuel pressure by fuel injector;

biasing means for biasing the needle toward the valve closed position;

a control chamber for biasing the needle toward the valve closed position by the fuel pressure controlled in cooperation with the biasing means;

an electromagnetic valve for controlling the fuel pressure of the control chamber; and a flow rate controller provided in at least one passage of the fuel passage on the oil accumulation chamber side downstream near the branch portion and the fuel passage on the control chamber side, wherein the fuel distribution passage extends from the common rail toward each of the fuel injectors is branched to a fuel passage on the oil accumulation chamber and a fuel passage on the control chamber side extended to the control chamber by a branch portion formed at the inlet to the fuel injector, wherein, the flow rate controller controls the flow through the flow rate controller to have a ratio with respect to the flow rate of the fuel generated in the one passage, equal to a value obtained by dividing a difference between a total pipe volume and the volume of the one passage by the total pipe volume, wherein the total pipe volume is the sum of the volume of the common rail and volumes of all the distribution passages and supply passages.

11. An accumulator fuel injection device for an engine having one or more cylinders according to claim 10, wherein by providing the flow rate controller in the fuel passage on the oil accumulation chamber side downstream near the branch portion, fuel having a flow rate of a ratio, with respect to the flow rate of fuel through the fuel passage on the oil accumulation chamber side, equal to a value obtained by dividing a difference between the total pipe volume and the volume of the fuel passage on the oil accumulation chamber side by the total pipe volume.

12. An accumulator fuel injection device for an engine having one or more cylinders according to claim 10, wherein the flow rate control comprises an orifice serving as a fixed throttle.

13. An accumulator fuel injection device for an engine having one or more cylinders according to claim 10, wherein the flow rate controller comprises a valve serving as a variable throttle.

14. An accumulator fuel injection device for an engine having one or more cylinders according to claim 10, wherein the flow rate controller further comprises means for setting the distribution of the flow rates of fuel to the fuel passage on the oil accumulation chamber side and the fuel passage on the control chamber side.

15. An accumulator fuel injection device for an engine having one or more cylinders, comprising:

a fuel injector provided for every cylinder of the engine;

a common rail for accumulating pressurized fuel to be supplied to the fuel injector;

a high pressure feed pump for supplying a high pressure fuel to the common rail;

a fuel distribution passage connecting the common rail and the fuel injector;

a fuel supply passage connecting the common rail and the high pressure feed pump;

an oil accumulation chamber for biasing a needle toward a valve opening position by the fuel pressure by the fuel injector;

a biasing means for biasing the needle toward a valve closed position against this;

a control chamber for biasing the needle toward the valve closed position by the fuel pressure controlled in cooperation with the biasing means; and an electromagnetic valve for controlling the fuel pressure of the control chamber, a flow rate controller provided in at least one passage of the fuel passages on the oil accumulation chamber side downstream near the branch portion and the fuel passage on the control chamber side, wherein the fuel distribution passage extending from the common rail toward each of the fuel injectors is branched to a fuel passage on the oil accumulation chamber side extending to the oil accumulation chamber and to a fuel passage on the control chamber side extending to the control chamber by a branch portion formed at the inlet to the fuel injector, wherein the flow rate controller sets the distribution of the flow rates of fuel to the fuel passage on the oil accumulation chamber side and to the fuel passage on the control chamber side.

16. An accumulator fuel injection device for an engine having one or more cylinders according to claim 15, wherein:

the flow rate controller in the fuel passage on the oil accumulation chamber side downstream near the branch portion, fuel having a flow rate of a ratio with respect to the flow rate of fuel through the fuel passage on the oil accumulation chamber side, equal to a value obtained by dividing a difference between a total pipe volume the common rail volume and volumes of all and the volume of the fuel passage on the oil accumulation chamber side by a total pipe volume, and the total pipe volume is the sum of the volume of the common rail and volumes of all the distribution passages and supply passages.

17. An accumulator fuel injection device for an engine having one or more cylinders according to claim 15, wherein the flow rate controller comprises an orifice serving as a fixed throttle.

18. An accumulator fuel injection device for an engine having one or more cylinders according to claim 15, wherein the flow rate controller comprises a valve serving as a variable throttle.

19. An accumulator fuel injection device for an engine having one or more cylinders according to claim 15, wherein the flow rate controller comprises an orifice which is provided in the fuel passage on the oil accumulation chamber side and has a smaller opening area than that of the fuel passage on the oil accumulation chamber side.

20. An accumulator fuel injection device for an engine having one or more cylinders, comprising:

a fuel injector provided for every cylinder of an engine;

a common rail for accumulating pressurized fuel to be supplied to the fuel injector;

a high pressure fuel pump for supplying high pressure fuel to the common rail;

a fuel distribution passage connecting the common rail and the fuel injector;

a fuel supply passage connecting the common rail and the high pressure feed pump; and a flow rate controller in at least one of the fuel supply passage, the common rail, the fuel distribution passage, and a passage inside the fuel injector, wherein the flow rate controller controls the flow rate through the flow rate controller to have a ratio, with respect to the flow rate through the high pressure feed pump, equal to a value obtained by dividing a difference between a total pipe volume and the volume of the fuel supply passage from the high pressure feed pump to the flow rate control means by the total pipe volume, wherein the total pipe volume is the sum of the volume of the common rail and volumes of all the distribution passages and supply passages.

* * * * *